US007099136B2

(12) United States Patent
Seale et al.

(10) Patent No.: US 7,099,136 B2
(45) Date of Patent: Aug. 29, 2006

(54) STATE SPACE CONTROL OF SOLENOIDS

(76) Inventors: Joseph B. Seale, 98 Day Rd., Gorham, ME (US) 04038; Gary E. Bergstrom, 191 Miles Rd., Moreland Hills, OH (US) 44022

( * ) Notice: Subject to any disclaimer, the term of this patent is extended or adjusted under 35 U.S.C. 154(b) by 358 days.

(21) Appl. No.: 10/691,957

(22) Filed: Oct. 23, 2003

(65) Prior Publication Data

US 2004/0083993 A1 May 6, 2004

Related U.S. Application Data

(60) Provisional application No. 60/420,536, filed on Oct. 23, 2002.

(51) Int. Cl.
*H01H 47/00* (2006.01)

(52) U.S. Cl. ..... 361/152; 361/160; 123/90.11

(58) Field of Classification Search ..... 361/152
See application file for complete search history.

(56) References Cited

U.S. PATENT DOCUMENTS 6,208,497 B1 * 3/2001 Seale et al. ..... 361/160
6,249,418 B1 6/2001 Bergstrom ..... 361/152
6,285,151 B1 9/2001 Wright et al. ..... 318/560
6,366,199 B1 * 4/2002 Osborn et al. ..... 340/438
6,634,248 B1 * 10/2003 Ito ..... 74/336 R
6,657,847 B1 * 12/2003 Wright et al. ..... 361/160
6,681,728 B1 * 1/2004 Haghgooie et al. ..... 123/90.11

OTHER PUBLICATIONS

Butzman, Melbert, Koch; "Sensorless Control of Electro-Mechanical Actuators for Variable Drive Train;" SAE paper 2000-01-1225.
Peterson, Stefanopoulou, Wang; "Control of Electrochemical Actuators: Valves Tapping in Rhythm;" UCSB Feb. 2002.
Hoffman, Peterson, Stefanopoulou; "Iterative Learning Control for Soft Landing of Electro-Mechanical Valve Actuator in Camless Engines;" Sep. 10, 2000.

* cited by examiner

*Primary Examiner*—Robert L. Deberadinis
*Assistant Examiner*—Luis Roman
(74) *Attorney, Agent, or Firm*—Nils Peter Mickelson

(57) ABSTRACT

A system and method for state space control of solenoids, particularly engine valve solenoids with two latching positions. A collection of trajectories are computed or measured, having low-impact landings with latching from different initial energies. The trajectories define flux linkage and electric current functions of the two variables, position and velocity. These tracking functions define future projections based on present inputs. In operation, the controller monitors position, velocity, flux linkage, and current, uses the functions to compute future current and flux linkage, and adjusts the drive voltage to hit the future flux linkage target, causing the system to track a precomputed trajectory to successful landing. An array of tracking functions incorporates varying valve flow influences and corrective actuation. Drift from a precomputed trajectory indicates an unanticipated valve flow influence and a new tracking function selection, leading to course corrections anticipating flow influences.

37 Claims, 11 Drawing Sheets

Fig. 13 TRACK Sequence Chart 1300 initial P# ', nΦ', PWM', B+, I', PWM 1302

↓

Start 1 1304

↓

Read A/D: I 1306

↓

PWM to Output 1308

↓

Va'( B+, PWM' ) 1310

↓

Vr'( I, I', PWM', R) 1312

↓

Vi' = Va' – Vr' 1314

↓ nΦ = nΦ' + Vi' • dt 1316

↓

X( I/nΦ ) 1318

↓

IF going THEN dX = X – X' 1320

↓

IF going THEN P#( X, dX ) ELSE P# = P# ' 1322

↓

IF new strip THEN load new target strip 1324

↓

$n\Phi_{++}$( P#, X ) 1326

↓

$I_{++}$( P#, X ) 1328

↓

Vr( I, PWM, R ) 1330

↓

Vi( PWM, B+, Vr ) 1332

↓

$Vi_{+}$ = (($n\Phi_{++}$ – nΦ)/dt) – Vi 1334

↓

$PWM_{+}$( ($Vi_{+}$ + IR), B+ ) 1336

↓

$Vr_{+}$( $I_{++}$, $PWM_{+}$, R ) 1338

↓

$PWM_{+}$( ($Vi_{+}$ + $Vr_{+}$ ), B+ ) 1340

↓

IF tracking THEN Start 1 ELSE end 1342

↓

Fig. 14 RELEASE & CAPTURE 1400
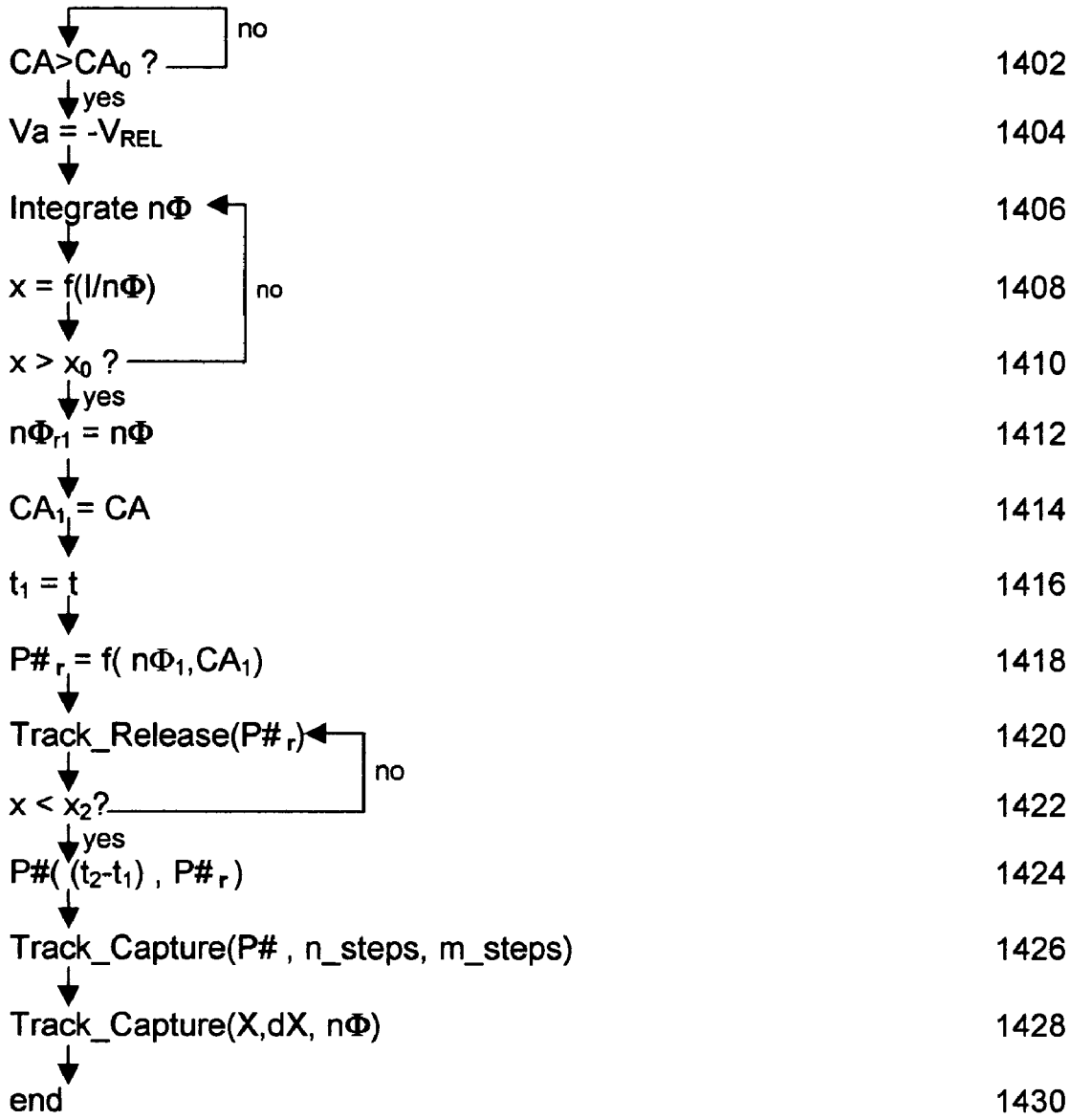

MDK
init Xd
Fm
F
Fk
Xdd
X/Y
dt
Xd
X-Xinit
Fk
X
Xd
Xd,max
Xc
Fh
Mass
.185
Xctr
.004
K
166750
init X-Xctr
X/Y X
X_Pos
X>0
Xmin
.00025
X0
.0016
1/u
Yx
Ye
Xe
Y0
Yx/Ye
BGap
PhiGap
Fm
Phi
nl
CtrArea
4.84E-4
2/Mu0
Mu0
Ye/Yx
PhiHold
Fh
PhiGap

STATE SPACE CONTROL OF SOLENOIDS

CROSS-REFERENCE TO RELATED APPLICATIONS

Provisional Patent Application 60/420,536 filed 2002 Oct. 23.

STATEMENT REGARDING FEDERALLY SPONSORED RESEARCH OR DEVELOPMENT

Not applicable

FIELD OF THE INVENTION

This invention relates to state space control methods for guiding trajectories in solenoids, including engine valve solenoids.

BACKGROUND OF THE INVENTION

State space control methods have been applied successfully to the control of electromagnetic actuators, particularly to the comparatively linear problem of motion control in read-write heads for computer disk drives. Of particular concern, however, are solenoids with two latching positions and a strong spring driving the armature from one latching position to the other. Such "dual-latching" solenoids, of particular use in electromagnetic engine valves, have proved difficult to control. In them, the dominant force comes from a spring system that restores the armature towards a point roughly midway between the two latching positions. Even when driven to saturation, a magnetic yoke cannot pull in and latch the armature starting from a centered rest position. Solenoids of this type must generally be initialized by resonating the armature from side to side several times until it comes close enough to a yoke for capture and latching. Once latched, the armature is released from one side and speeds to the other side, driven mostly by spring force. Magnetic control is effectively lost on release when the armature has passed roughly 20% of its transit distance, while pull-in control becomes effective only in the final 20% or so of travel. To bring such a solenoid up to near saturation and maximum pull across a large armature gap, for example, across 20% of maximum travel, typically requires on the order of one joule of magnetic energy. If the solenoid drive circuit is limited to a moderately high peak power level, for example, two kilowatts for a strong field across a 20% gap, the implication is that about a half millisecond should be required either to build up or break down the magnetic field, as needed to effect a large fractional change in magnetic force. This time figure, about a half millisecond, turns out to be roughly the minimum time to bring magnetic force from zero up to a maximum near saturation, or from that maximum back down to zero. Given a total stop-to-stop solenoid travel time of around three milliseconds, this half-millisecond one-way slew-time figure indicates a severe slew rate constraint for a controlled change of magnetic force. The extent of course correction is therefore severely constrained.

While peak velocities exceeding 3 meters/second are commonly required for sufficient solenoid speed, armature landing impact velocities are desirably held to about 0.03 meters/second or less—only 1% of the peak velocity. Since kinetic energy varies as the square of velocity, a 1% velocity error at landing represents a 0.01% error in kinetic energy, relative to the maximum. By implication, if a low-impact landing strategy were to rely solely on a kinetic energy determination at mid-course, then the energy correction would need to be precise to within 0.01%. Since the trajectory of the armature near landing is unstable and divergent, however, the allowable error in mid-course energy correction needs to be well below 0.01% for open-loop low-impact landing. If such precision is impractical on a laboratory bench, it is impossible in a vibrating engine with turbulent gases swirling past the actuated engine valve. Closed loop control is clearly necessary to control landing energy in a range below 0.01% of peak kinetic energy.

To perform well and land softly under variable operating conditions in an internal combustion engine, dual-latching electromagnetic valve actuators require an "intelligent" closed-loop control process to guide the system trajectory along a narrow landing path, allowing only a few percent of energy deviation before the system strays too far off course for possible correction. Too fast an approach leads to unavoidable impact and bounce. Too slow an approach commonly causes the armature to lose momentum and possibly even reverse direction momentarily, after which an increasing magnetic field overpowers the reversal of motion and pulls the solenoid in for a high-impact landing. An even slower approach results in complete failure to land—even the maximum possible field in deep magnetic saturation cannot reach across the air gap with sufficient strength to bring the armature in against the opposing spring force. These situations are analogous to trajectory control for spacecraft re-entry into Earth's atmosphere from lunar orbit—too steep an entry burns the craft, slightly too shallow an entry causes the craft to bounce off the atmosphere and then burn on too steep a second entry, and an even shallower entry bounces the craft far off into space. Solenoid course corrections must be initiated early, by analogy to exit from lunar orbit. Release from a latching side of a solenoid may require control in order for the opposite, capturing side of the solenoid to bring about successful landing. Consider, for example, where exhaust gas pressures retard the opening of a solenoid-driven valve. The releasing solenoid should reduce its field rapidly after release, to minimize the magnetic retarding force on the departing armature. On the other hand, when pressure in a supercharged intake manifold boosts the energy of an opening intake valve, the releasing solenoid should increase its magnetic strength quickly after release, to reach out and retard the departing armature, removing some of the excess energy.

Under the circumstances just described, generic feedback control schemes are ineffective. The most effective control system embodies specific knowledge of the nonlinear characteristics of the solenoid to be controlled. Effective control requires a built-in description of the range of trajectories that can, under feedback control, be directed to low-impact landing, starting from variable initial energy conditions. By the spaceship analogy, the system must contain a description of the envelope of possible paths that can reach successful landing. The system must be capable of maintaining the system trajectory within the confines of that envelope.

The best available examples from existing control technology in this area fail to meet the challenges just described. Working valve solenoid actuators have been demonstrated, but landing impacts under variable engine operating conditions create noise problems and limit the longevity of solenoid components. The tightest control systems require separate motion sensors for servo feedback, while only one reported "sensorless" control system offers the possibility of multiple trajectory corrections on approach to landing.

In U.S. Pat. No. 6,285,151, Wright and Czimmek describe a sensorless "Method of Compensation for Flux Control of an Electromagnetic Actuator." Similar material is described in the 2000 SAE Congress paper 2000-01-1225, "Sensorless Control of Electromagnetic Actuators for Variable Valve Train" by Melbert and Koch. In U.S. Pat. No. 6,657,847, Wright and Czimmek further describe an alternative sensorless "Method of Using Inductance for Determining the Position of an Armature in an Electromagnetic Solenoid," and in U.S. Pat. No. 6,681,728, Peterson, Stefanopoulou, Megli and Haghgooie disclose a similar "Method for Controlling an Electromechanical Actuator for a Fuel Charge Valve."

Both Wright '847 and Haghgooie '728 view the control problem from the standpoint of being in the right place at the right time and each teaches a method of continuously monitoring velocity, position and current together and adjusting drive voltage each time an error is observed. These methods provide empirical formulas for specific points of course correction in the trajectory of a solenoid moving from one latching position to an opposite latching position, with a goal of low-impact landing with simultaneous magnetic latching. Such systems as these provide some measure of control, but less than is needed for a versatile, quiet-running and long-lasting system. In the words of Wright '847: "Generally, PID (proportional, integral, derivative) control systems can only perfectly compensate a linear system with state variables that are not interactive. Electromagnetic actuators are, however, highly non-linear (and) the state variables are highly interactive."

In light of the current invention, these methods warrant detailed discussion.

Concerning time and control, Wright '847 explicitly departs from the PID control methods, stating (column 2, lines 41–65) that ". . . there is a need for a true multivariate control system capable of controlling all state variables simultaneously and compensating a nonlinear feedback control system." Wright '847 goes on to describe a state space whose dimensions are position, velocity, electrical current and time. As shall be shown, a better selection would be to eliminate the dimension of time altogether and to substitute flux linkage for current, resulting in simpler, more linear relationships and improved system stability.

The special significance of three state space dimensions (as opposed to any other number) is the number of time-integration delays between a control input change and response in position. Starting from a control voltage, current and flux linkage vary as the time integral of voltage, so that's one "delay." Magnetic force and acceleration changes occur with virtually no delay in relation to flux, so the next significant integration delay is going from force and acceleration to velocity. The third integration delay is in going from velocity to position. All solenoids are subject to at least third-order delay. Current controllers can only alter current at rates permitted by their voltage output range. The slew rate for current varies with the maximum volts-per-turn in the winding. Raising the supply voltage calls for higher-voltage transistors and higher instantaneous power capability. Lowering the number of windings causes the solenoid to draw more current, again raising the instantaneous power demand and also increasing power losses from fixed resistances in transistors and circuit board traces. There is a strong economic incentive to design a solenoid system for operation within relatively low slew rate limits. Voltage limiting in current control systems creates a very difficult slew-rate nonlinearity. Applicant's system will be seen to use pre-planned control trajectories within system voltage limits, avoiding slew by design.

Current controllers can only alter current at rates permitted by their voltage output range. The slew rate for current varies with the maximum volts-per-turn in the winding. Raising the supply voltage calls for higher-voltage transistors and higher instantaneous power capability. Lowering the number of windings causes the solenoid to draw more current, again raising the instantaneous power demand and also increasing power losses from fixed resistances in transistors and circuit board traces. There is a strong economic incentive to design a solenoid system for operation within relatively low slew rate limits. Voltage limiting in current control systems creates a very difficult slew-rate nonlinearity. Applicant's system will be seen to use pre-planned control trajectories within system voltage limits, avoiding slew by design.

Considering practical solenoids of the type used to actuate internal combustion engine valves, the spring forces are so high that they easily dominate over the controllable magnetic force across much of the armature's range of travel. As noted in Haghgooie '728, the solenoid controller exerts very low "control authority," caused both by the dominance of the spring force and by the 'open' position of the armature over most of its travel. The solenoid acts primarily as an oscillating spring-mass system whose motion is only under significant controller influence when the armature is very close to one or the other of the two attracting pole faces. Wright '847 states (col. 11, lines 18–22) that "As a rule of thumb, the armature should be close enough to the stator core that the amount of magnetic flux closed through the core is at least equal to the amount of flux that escapes the core."

In fact, it can be shown that in the region between 20% and 80% of full travel, motion is virtually unperturbed by control action and is governed primarily by the simple harmonic motion of the spring/mass system. As a further important consequence, it is virtually impossible for any controller to significantly influence the overall transit time from armature release to armature recapture. By the time an armature arrives at the final 20% region of significant landing control force, it is too far behind or ahead of schedule for correction, unless its initial kinetic energy was virtually unperturbed by variable operating conditions.

Examining wright '847 in more detail, we find in 130 of FIG. 12 a graph labeled "Soft Landing Position vs. Time." As is clear throughout wright '847, the armature trajectory is intended to be controlled to track along a single preferred position-versus-time trajectory, such as trajectory 130. Observation, though, shows that in a solenoid system with low control authority, this approach falls short. An armature whose release opens an automotive exhaust valve (for example) will lose energy quickly after release due to a combination of weak magnetic attraction and strong opposing gas forces from out-rushing exhaust. By mid-course, the armature and valve will have a perturbed kinetic energy due to varying launch conditions. No magnetic controller can be expected to cause such variably perturbed trajectories to converge onto a single position-versus-time graph ending at a specific elapsed time after release. Wright '847 calls for the system to do just that. The consequence is that Wright's system can only successfully control armature motions within a very restricted range of energies established shortly after armature release.

As with the teachings of Wright '847, Haghgooie '728 implies a specific, restrictive time schedule for position, as at column 4, lines 20–25: "In each stage in the operation of the closed-loop controller, the voltage command signal generated by the controller is equal to:

$$\text{Voltage}=K_i(i_{desired}-i_{measured})+K_x(X_{desired}-X_{measured})+K_v(V_{desired}V_{measured})"$$

The values of three state variables, current, position and velocity, are each subtracted from "desired" control values of current, position and velocity at specific moments in time. Haghgooie '728 describes procedures for a flux initialization stage and for a landing stage, but it makes clear that in both stages, the form of the control equation is the same. Little is said about how said desired values are established, except that closed loop control is employed, that there is a switch from a flux initialization algorithm to a soft landing algorithm, and that (column 4, lines 32–34) "In the preceding equation, $K_i$, $K_x$, and $K_v$ are constants that are determined using a known linear quadratic regulator optimization technique (LQR) ." There is no discussion of the three "desired" state variables i, x and v, but clearly they are at least functions of time.

Both Wright '847 and Haghgooie '728 rely on a single "desired" path through state space, wherein every position coordinate along that path is a predetermined function of the time dimension. Note that in Wright '847's FIG. 12, graph 130 defines a target position versus time for a single trajectory path through state space. Graph 132 in that same figure, plotting velocity as a function of position, is derived from position information that is already fully defined by the positions and slopes of graph 130. These two graphs simply represent different views of a single trajectory through state space, rather than information about two or more trajectories. Note further that the proportional and rate signals represented at 136 and 140 of the figure are used to derive the third dimension of the state space, in this case expressed as a target electric current. Both Wright '847 and Haghgooie '728 describe methods for causing a servo-controlled trajectory to attempt to track a single, specific target path, itself described as a function of time.

Because inductance places a practical upper limit on the slew rate of the flux linkage curve, and because a solenoid yoke can only attract and cannot repel an approaching armature, there are very restricted options for achieving the simultaneous arrival of flux at its latching value and velocity at a near-zero landing value exactly when the landing position is reached. As shall be made clear, eliminating the time constraint affords a simpler, more effective method for converging to a target strip of trajectories with a finite width in three-dimensional state space. That strip, defined by a collection of known successful trajectories pre-derived from testing or simulation, permits choosing a trajectory most closely aligned with the solenoid's present state, whenever measured, and gradually steering it to a successful landing, thus avoiding flux slew-rate limiting.

A paper by Peterson, Stefanopoulou, and Wang, "Control of Electromechanical Actuators: Valves Tapping in Rhythm" (in Multidisciplinary Research in Control: The Mohammed Dahleh Symposium 2002. Eds. L. Giarre' and B. Bamieh, Lecture Notes in Control and Information Sciences N. 289, Springer-Verlag, Berlin, 2003, ISBN 3-540-00917-5) describes valve actuator control systems at three levels: a linear controller using different approximate equations for the armature far from and near to the attracting yoke; a nonlinear controller; and the same nonlinear controller enhanced by an inter-cycle adjustment, a learning algorithm achieving a desired low level of impact after several training cycles. Earlier related papers by Peterson, Stefanopoulou and others include the titles "Nonlinear Self-Tuning Control for Soft Landing of an Electromechanical Valve Actuator" (K. Peterson, A. Stefanopoulou, Proceedings of IFAC Mechatronics Conference, November 2002) and "Iterative Learning Control of Electromechanical Camless Valve Actuator." (K. S. Peterson, A. G. Stefanopoulou, Y. Wang, T. Megli, Proceedings IMECE DSCD 2003-41270.) These papers describe various aspects of a controller that employs frequent sampling of position to infer all the state variables of the system. As the first-mentioned paper (above) states: "The system suffers from low control authority in controlling the armature position from the voltage input throughout the executed motion. The underlying reasons are dynamic during small gaps and static during large gaps." The low static authority during large gaps, as described above, arises because for most of the travel between 20% and 80% of the travel interval, the force of the mechanical spring substantially exceeds the maximum achievable electromagnetic force. As is emphasized in the invention to be described below, most control of the armature trajectory must be exerted early (below 20% of travel) and late (above 80% of travel) in the transition from open to closed gap, although it becomes necessary to anticipate control forces late in the transition by building up a magnetic flux ahead of time, when forces are weak.

The low dynamic authority during small gaps is explained by Peterson et. al. (in the first-mentioned paper above) in terms of "decreased inductance combined with high back-emf that drives the current to zero exceedingly fast." This statement may be considered confusing (inductance is not "decreased" but becomes very large at small gaps). At issue is a confusing selection of state variables: position, velocity, and current. A less confusing and mathematically "better behaved" representation to be employed below chooses these state variables: position, velocity, and magnetic flux linkage, that is, the flux that effectively threads the coil windings. For an "ideal" solenoid consisting of an infinitely permeable core material and achieving perfect magnetic closure at the latching point, the mathematical representation of the papers by Peterson et. al. becomes singular at magnetic closure, with current going to zero, inductance and back-emf going to infinity as closure is approached at a finite velocity, and magnetic force becoming infinitely sensitive to the vanishing current.

Returning to the first paper, "High cost and implementation issues preclude the use of sensors to measure all three states. For each of the controllers presented later in Sect. 7 only a position sensor is used, and an observer is implemented to estimate velocity and current. Unfortunately, the observability matrix $[C^T (CA)^T (CA^2)^T]^T$ where A is from the far model and C=[0 1 0], is ill-conditioned. Therefore one or more states are weakly observable from the position measurement." This "observer" is a computation to infer the unmeasured state variables, velocity and current, based on incoming position data. To say that the observability matrix is ill-conditioned is to indicate that the computational procedure is error-prone. From the same paper, "The current estimate matches the actual state closely for the initial part of the transition, with the estimation error increasing toward the end. Recall that (20) does not include the saturation region in (6)–(8), thus at the end of the transition when saturation occurs the nonlinear model is not accurate." This inaccuracy cannot be ignored, because the end transition is the region where the landing trajectory must be fine-tuned for low-impact landing. Furthermore, the statement, " . . . at the end of the transition when saturation occurs . . . " is either questionable or implies poor control. Static tests of solenoid force and current at various armature positions generally indicate saturation by a slowing of the increase of force with progressive reduction of the armature-yoke gap. These static tests do not reflect dynamic gap closure, where the magnetic flux linkage changes fractionally by only a small amount while coil current may be reduced by ten-to-one or more as the solenoid closes. As an efficient solenoid closes, the relatively constant magnetic flux linking the winding progressively redistributes to bridge the magnetic gap and become linked to the armature. When the solenoid finally closes, virtually all the winding flux linkage also links the armature portion of the magnetic circuit, producing magnetic force. It is not productive to generate more winding flux than can go through the armature at saturation, for the excess flux linkage will cause a high current and high power consumption with a negligible increase in magnetic force. The solenoid should be designed so that the flux capacity of the armature is similar to or slightly less than the flux capacity of the yoke (recognizing that minimizing armature moving mass drives the designer to keep the armature flux capacity no higher than needed.) The controller, in turn, should both compute and control flux, and should include and utilize a model of saturation flux linkage as a variable function of armature position. Recognizing that saturation boundary, the controller should utilize the full flux allowed within that boundary, as needed, without crossing the boundary and dissipating power unproductively.

Going more deeply into the issue of control in the magnetic end transition region, that region frequently corresponds to an engine valve approaching mechanical closure with gases moving rapidly through the closing valve. As the valve approaches closure and interrupts the gas flow, the pressure differential across the valve will increase abruptly, exerting a force that alters the trajectory and causes either closure with impact, or a bounce away from completion of closure, followed either by delayed closure with impact or by complete failure to close and latch. A control system is needed that can do more than get through an end transition to low-impact landing on a laboratory bench, after many learning cycles. The control system needs to maintain a complete model of the system state variables and be capable of making appropriate course corrections on-the-fly, with conditions varying from one cycle to the next. The system should infer the presence of unexpected gas forces based on deviations of the system trajectory from an expected course through the state space. The system should respond to these deviations not only by way of feedback correction, but also with feed-forward correction, based on a built-in gas dynamic model that anticipates coming changes in gas-dynamic forces using present course deviations. Because of the well-recognized third-order response "sluggishness" of solenoid actuators, a system is needed that accomplishes corrective feed-forward actuation in a short time frame, with only a few computations.

The dynamic models taught in the references by Peterson et. al. include a pair of linear models, one for large magnetic gaps and one for small magnetic gaps, and a nonlinear model, applied during the particularly nonlinear small gap region. The nonlinear model, which slightly outperforms the linear model, employs the following control equation:

$$V_c=K_1\cdot v/(\gamma+z)+K_2/(\beta+z) \quad (1)$$

In Eq. 1, $V_c$ is applied control voltage, z is armature position, v is armature velocity, and the four coefficients $K_1$, $K_2$, $\gamma$, and $\beta$ can be varied to optimize landing. The needed optimization is based on an extremum-seeking mathematical procedure that adjusts the four coefficients and optimizes landings iteratively over several actuation cycles. This process is empirical and does not benefit from a more detailed and mechanistic model of the nonlinear state-space dynamics of the controlled system. On the other hand, detailed models have previously been associated with lengthy computations, incompatible with the design of real-time controllers that must respond to incoming sense signals with control output signals in a short time frame, for example, between tens and hundreds of microseconds in a system to control a trajectory lasting under four milliseconds. What is needed and not provided by earlier articles and patent teachings is a control approach that incorporates a complex dynamic model into a procedure that dictates control responses with few computations.

A feedback trajectory control system taught by Bergstrom in U.S. Pat. No. 6,249,418 uses coil current measurement, as in the system of Wright and Czimmek, but in this case the system infers position and magnetic flux linkage at many sampling points along the trajectory, approaching continuous feedback control. Velocity is computed from changes in position. This system is therefore an example where the chosen state variables are position, velocity, and flux linkage. The system derives all the information for a complete state space description at frequent sampling intervals, without some of the indeterminacies that plague the system reported by Peterson, Stefanopoulou and others in the above three references. In particular, the system by Bergstrom is immune to unexpected magnetic saturation, since the primary control is over magnetic flux.

In one of the approaches taught by Bergstrom, solenoid electric current is measured at frequent intervals while inductive voltage is inferred from supply voltage, from the microprocessor Pulse Width Modulation (PWM) setting or duty cycle, and from knowledge of the solenoid current and circuit resistance. The inductive voltage is integrated over time, starting from a time of known zero or near-zero solenoid flux, to give the coil flux linkage. Solenoid position is determined as a function of the ratio of current to flux linkage, referred to in Bergstrom's patent simply as flux. Once position is determined, comparison of the most recently determined position with one or more previous position values indicates solenoid velocity. From solenoid position and flux linkage, it is possible to compute magnetic force. Combining a knowledge of force with corrective feedback, one can obtain linearized control of force, at least within limits of saturation and slew rate of the magnetic field producing the force. With knowledge of position, velocity, and force, and with actuation control over the rate-of-change of force via PWM control, one might expect to be able to apply well known control theory to the solenoid trajectory, as suggested by Bergstrom. Several problems arise in practice, however, largely related to the "low control authority" described by Peterson, Stefanopoulou and others. In the framework of position, velocity, and flux linkage as state variables, the "control authority" problems consist of low force at large gaps for any attainable flux linkage, and a voltage-limited slew rate of flux linkage, preventing rapid changes in that state variable. A related system boundary is the saturation limit of flux linkage. As will be described in detail below, these boundaries constrain the dynamic trajectory of the system to a narrow path in state space. If the system strays outside this path, it cannot be brought back in time, resulting in high-impact landing and/or failure to latch—the analogy to spacecraft reentry into Earth's atmosphere starting from lunar orbit is recalled. Bergstrom fails to disclose specific methods for maintaining a fast solenoid system trajectory within narrow path boundaries, although the flux control method taught by Bergstrom is a useful start in creating such methods.

Like the system described by Peterson, Stefanopoulou and others, the system by Bergstrom combines information from a single measured variable with knowledge of a second variable, for example, the drive voltage or control voltage, $V_c$, appearing in Eq. 1. The system by Bergstrom has the advantage that the measured variable, current, is easily measured at the controller circuit board, whereas a direct position measurement requires a sensor at the actuator, in the harsh engine environment. An appropriately robust sensor for this use, as shown in the first-mentioned paper (above) by Peterson et. al., is an eddy current sensor, measuring a position-dependent AC impedance and requiring oscillator and demodulation or detection circuitry. While the two state-variable choices, of (position, velocity, flux-linkage) versus (position, velocity, current), are formally equivalent in that the one description can be transformed into the other, the flux-linkage choice leads readily to simpler expressions, useful in mapping out a comprehensive description of pre-computed state space trajectories, which is a novel basis for the invention to be described below.

OBJECTS OF THE INVENTION

Recognizing the difficulties and limitations of earlier control systems for solenoids including dual-latching solenoids, and seeking more effective methods for the control and low-impact landing of such solenoids, particularly as applied to the actuation of cylinder valves in internal combustion engines, it is broadly an object of the present invention to pre-define, from detailed knowledge of the dynamic characteristics of the controlled electromagnetic and mechanical system, a set of trajectories representing possible paths through a state space to desired low-impact landings, and to cause actual controlled trajectories of the system to converge to and follow these pre-defined trajectories. In more detail, it is an object to describe, by parameters stored in a computer memory, at least one mathematical surface in a state space, representing a collection of possible trajectories of the solenoid, and where those trajectories all converge on a desired end condition or conditions, such as low-impact landing with magnetic latching, or such as intermediate positions in state space from which low-impact landing with latching can be achieved. It is a further object that at least one of such mathematical surfaces defines a function that, from trajectory measurement inputs, describes drive output settings for a solenoid controller, causing the solenoid to follow a state space trajectory roughly parallel to predetermined trajectories of the stored mathematical surface or surfaces. In a particular embodiment of this system, it is a further related object that the two-dimensional abscissas of a control surface be a computed position and a velocity indicator (which may be a difference in computed positions), while the ordinates of the control surface define values for a flux linkage target. In relation to control system abscissas and ordinates such as the ones just described, it is an object to construct a solenoid controller that determines, over time, position and flux linkage values associated with the actual trajectory of that solenoid; that uses the position values and velocity measures to compute flux linkage target values; and that sets solenoid driver output values in relation to the flux linkage target values, as compared to measured or computed flux linkage values associated with the current trajectory.

With the realization of the above trajectory-controlling system, it is an object that the controller compute deviations of an actual solenoid trajectory from the stored mathematical surfaces describing expected solenoid trajectories, those deviations being indicative of operating conditions differing from those conditions that were the basis for the stored mathematical surfaces. Employing these computed deviations, it is an object that the controller modify the solenoid driver output values on a subsequent actuation cycle, relative to the original state space trajectory description, in order to improve controller performance in low-impact landings and latchings on one or more subsequent actuation cycles. It is a further object to respond to computed deviations, within a single actuation cycle, by switching to a different stored mathematical surface describing different expected solenoid trajectories, more nearly reflecting variable conditions inferred from the observed deviations.

LIST OF FIGURES

FIG. 13 is a flow diagram of steps for feed-forward state space control.

FIG. 14 is a flow diagram incorporating the steps of FIG. 13 into the larger context of coordinated armature release and capture.

SUMMARY OF THE INVENTION

Figure 1:
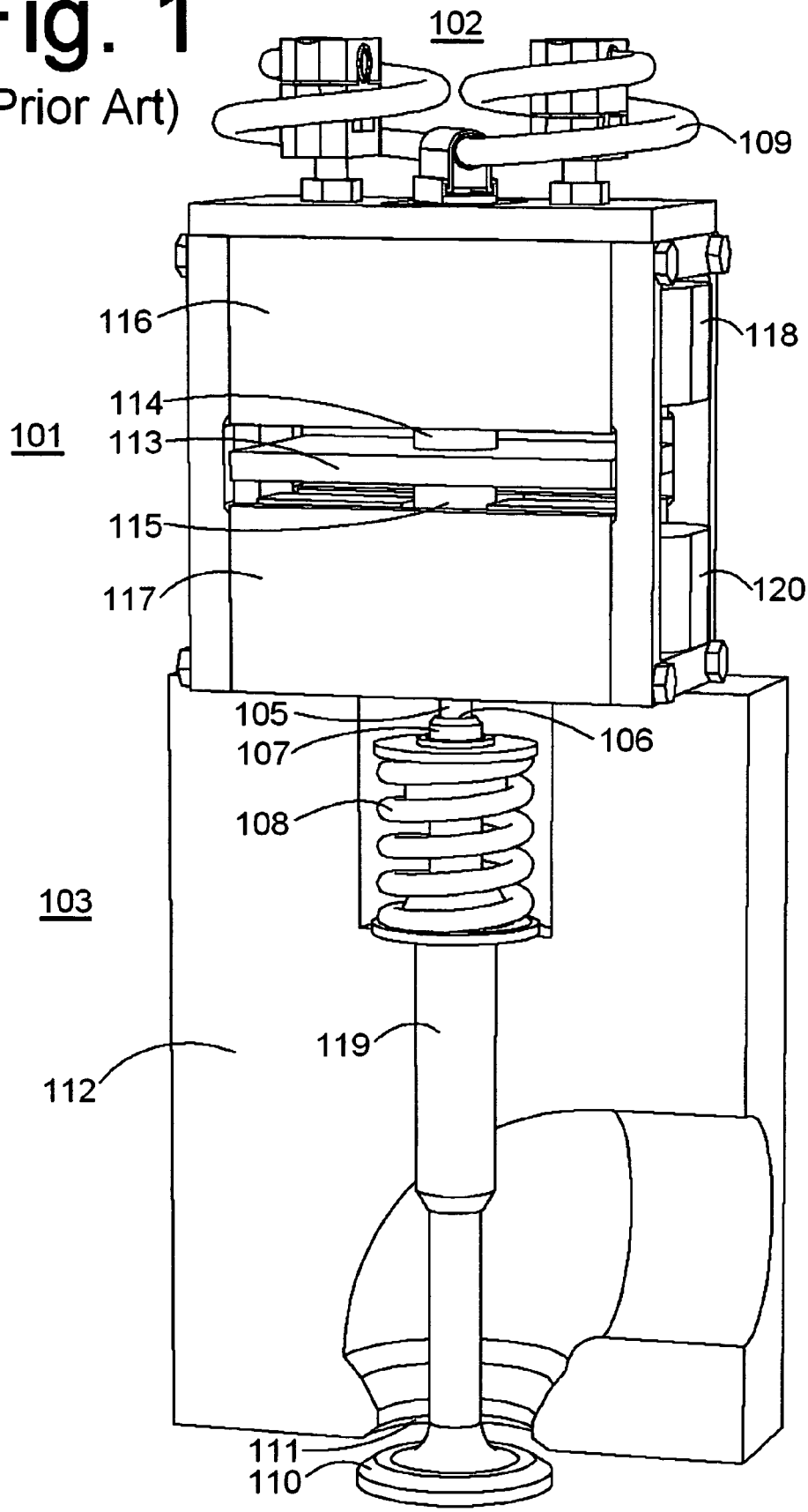
Fig. 1 (Prior Art)
FIG. 1 illustrates a dual-latching solenoid of the type that might be controlled by the invention.

The present invention is a solenoid controller including a data processor controlling a drive signal to the solenoid; a control program; memory capable of storing parameters that define a surface of converging landing trajectories in a state space; and sensor apparatus for determining the actual system location in the state space, in relation to the pre-defined surface of trajectories. The surface of trajectories should represent an accurate and detailed dynamic description of the solenoid system to be controlled. In addition, the trajectories should represent multiple predetermined paths converging to successful low-impact landings, with latching, starting from widely differing initial conditions. The desired "target" at the landing position is two-dimensional, characterized 1) by a low impact velocity and 2) by an electromagnetic flux or flux linkage reaching a latching value at the moment of impact. As will be shown, in the vicinity of impact the flux linkage should be rising fairly steeply, but adequately below a slew rate limit, with the result that landing is comparatively quick without "hovering" near the target, and also with the result that secure latching is obtained immediately after landing.

In conventional feedback control, error is computed with respect to a fixed target. A problem with the fixed target approach is that a high error gain tends to destabilize the system and also tends to cause slewing when the system is far from the target and therefore registering a large error. A traditional fix to this problem is derivative compensation or phase lead compensation, where rate-of-approach to the target is factored in along with distance to the target. Better control is achievable, however, in a state space description. Here, the system error may be defined with respect to a "moving target" defined as a function of a changing state variable, for example, changing position. In this case, there is a pre-defined target path to landing, embodying specific information about the system being controlled. A target path definition can provide additional information about how to get "from here to there" along a feasible trajectory that avoids problems such as slew rate limitations and magnetic saturation.

The present invention goes beyond a target path description, to a converging target strip, described as a two-dimensional surface in a three-dimensional state space. In an embodiment to be described, these three dimensions are position, velocity, and flux linkage, though other sets of variables carry equivalent information. Flux linkage is viewed as the "vertical" dimension of the state space, as plotted above a "horizontal" plane of position and velocity or a velocity indicator, such as a change in position over a finite interval. The system state at any moment is defined by a point in the three dimensions, that point falling below, on, or above the target strip. The vertical distance from the measured operating point to the pre-defined target strip is an error to be reduced quickly. This operating point traces a trajectory. The controller goal is to have this trajectory converge to the target strip, detecting the vertical error and controlling the signal to the solenoid driver in a manner to reduce that vertical error. The target strip itself converges to the two-dimensional landing target. The target surface is defined at position X=0, which is defined as the landing position, and the plane thus defined spans the dimensions of velocity and flux linkage. The center of the target is defined by a low velocity magnitude and by a flux linkage just sufficient to maintain latching, with the added property that the desired trajectory hitting the target plane be one of increasing flux linkage.

Along a trajectory, system error is defined as the positive or negative vertical distance between the system state point and the target path. Though the controlled system is third order and nonlinear, involving three layers of time integration between electrical drive voltage and position response, feedback response with respect to the target strip is first order and linear, yielding a simple definition for optimum convergence to the strip. Furthermore, the shape of the state space and the target strip is defined in the "future" relative to the present system state, since the target strip embodies detailed stored information from prior measurements and simulations of system characteristics. This "future" information is used to overcome the effects of discrete data sampling and computational delays in a sampled data system. With this accurate feed-forward information, the system trajectory does no lag behind changes in the height of the target strip, but converges vertically to a high accuracy limited in two ways: by the error and noise in sensing the state of the system; and by unpredicted external influences perturbing the system. These may be considered the "irreducible" errors relating to hardware limitations and an unpredictable environment. Minimizing the effects of these errors is discussed below.

The vertical dimension of the state space, which is the direction defining the lowest order feedback system (first order), is preferably flux linkage of the solenoid winding, although other variables such as coil current carry equivalent information. Flux linkage has the advantage of bearing a linear first-order relationship to voltage applied to the coil, after correction for resistive voltage loss. Beyond the first-order "layer" of control embodied in the procedure for correcting error in the vertical dimension of the state space, effective error gains and rates of convergence are variable along the path and controlled entirely by the design of the target strip. It may not be desirable to cause the target strip to converge too quickly to a narrow strip or line leading to landing, because forcing rapid convergence implies raising some form of error gain to a high level. Even if the design of the system, including its predictive or feed-forward ability, avoids instability at a certain high gain level, high gain implies strong response to sensor noise and analog/digital discretization error. In a sampled data controller, a measurement error will result in an incorrect drive signal, which is applied for a finite interval before an updated drive signal takes effect. If error gain is too high, measurement errors will be amplified excessively and will throw the system off course. If error gain is too low, the system will not correct strongly for the effect of unpredicted perturbing forces acting on the system, leading to excessive perturbation errors. Optimum design of the system establishes error-correcting gains for the best minimization of combined errors from external perturbations and from amplification of noise.

The control system of this invention provides the flexibility to optimize effective error gains at all levels and at all points along a trajectory. As in chess, a checkmate defines the single-minded "target" of a chess game, where a player will readily sacrifice the queen to achieve a quick checkmate, so with this control system, low-impact landing with secure latching is practically the sole objective. Significant but subordinate considerations include landing the system promptly without hovering or lingering near the target, landing the system in a consistent or predictable time period (for example, for consistent effective valve timing in internal combustion control), and latching securely. The system being described is so strongly constrained in feasible trajectories that there is little latitude for on-the-fly adjustment of speed or time of arrival at landing. Thus, even if in-flight information were available that might fine-tune valve timing, the system can do little to alter the effective timing once a trajectory is launched.

A target strip in state space need not narrow quickly to a line in a "rush" to minimize an imagined "error" in positioning relative to the center of the strip. Differing trajectory paths to the final landing target, spanning the width of the target strip, are entirely acceptable. The design of the target strip should keep the system well clear of slew rate limits, thereby maximizing the latitude for course-corrections, particularly relating to unexpected external perturbations. The design should respond to electrical noise glitches that might temporarily "blind" the path-sensing capabilities of the system, reverting to open-loop control of the driver output in the time sequence predicted by recent valid sensory data. Since the system continually defines and refines its description of the system state and the particular trajectory being followed to landing, information is available at all times for reverting to informed open-loop control in the event of a sensing glitch.

The target strip in state space typically consists of a set of predefined trajectory paths lying side-by-side and, by interpolation between them, defining a surface. These paths and the strip that they form can incorporate information both about solenoid response characteristics and about expected patterns of perturbation, for example, from gas flow forces in the control of engine valves. For example, if an exhaust valve is to be closed while exhaust gas is flowing back into a cylinder, providing controlled exhaust gas recirculation or EGR, then gas forces can be expected to impede the valve motion increasingly until closure is attained. Differing target strips can be selected from a path memory of multiple strips, with different strips being chosen for different operating conditions. Similar information can be exploited even when advance expectations of operating conditions are in error. As the system trajectory progresses down a target strip, the actual trajectory path is expected to run parallel to and coincident with a particular trajectory path of that strip. Unexpected perturbation forces will cause the system trajectory to show lateral movement across the target strip, crossing the predefined trajectory paths. Where such a lateral pattern of movement is resolved sufficiently to distinguish it from noise, the system can respond correctively by replacing the current target strip with another that reflects the observed trajectory direction. This response differs from simply increasing an error gain amplification, in that the pattern of error with respect to a given target strip can identify a perturbation whose future is predictable. The system can then respond appropriately, on-the-fly, altering the velocity and magnetic field strength with which it approaches landing in the anticipation that external forces will bring about desired results at landing. The control system and its state space path memory therefore comes to embody knowledge not just of the actuator, but of predictable characteristics of the system that interacts with the actuator.

In a solenoid, magnetic force cannot be changed instantly, but only at a slewing speed consistent with the limited voltage range that alters the electric current and flux linkage in a drive winding. To respond to unexpected external forces, those forces must be anticipated. When a solenoid must operate in a perturbing environment whose state may be unexpected, but whose changes may become predictable to some degree, once information about the environmental state is provided, then significantly better control results are possible when the controller incorporates information about the actuator and characteristics of the interacting environment. This information must be stored in a form that is immediately and directly useful in the single task of setting a sequence of output voltages from a controller over time. The remainder of this specification describes in greater detail a control system and information process in which detailed and immediately useful information is built into the control system and its memory, such that the system combines hardware-specific, stored, predictive information with well-utilized sensor data, resulting in reliable control and operation with low noise, low wear and cumulative impact damage, and the low energy consumption that goes with smooth, efficient operation.

DESCRIPTION OF A PREFERRED EMBODIMENT

The controller of this invention includes one or more sense inputs indicative of progress of the controlled solenoid armature motion along a particular trajectory, and it includes one or two actuation outputs controlling electrical drive signals to one or two magnetic yokes, in either a single-sided solenoid or in a dual-latching solenoid. The armature is restored by a spring system towards a neutral position away from contact with the one yoke of a single-sided solenoid, or away from both of the two magnetic yokes in a dual-latching solenoid. An example embodiment of a dual-latching solenoid of the sort that can controlled by the invention is illustrated in FIG. 1. In this illustration, a rectangular armature is shown midway between upper and lower E-core yokes. A shaft through the armature is guided by bushings (not visible) and presses on the end of an engine valve. A simple helical valve spring pushes the valve toward closure, while a stiffer double-helix spring at the top counterbalances the valve spring force when the valve is not seated and provides a strong centering force on the moving armature and valve assembly.

The function of primary interest for this invention is control of the electrical drive signals to the two yoke windings of a solenoid system like that of FIG. 1, or to the single yoke winding of a one-sided solenoid. The major components of FIG. 1, which are familiar in the prior art, are reviewed briefly here. A dual-latching solenoid assembly 101 includes an armature 113 which can be attracted to either of two yokes: a top yoke consisting of ferromagnetic core 116 and winding 118, and a bottom yoke of core 117 and winding 120. Features 114 and 115 on the top and bottom of the armature are clamp components securing the armature to a shaft 105, visible here where it emerges from a hidden bushing and makes contact, at contact point 106, with a valve shaft 107. This valve shaft is itself guided by bushing 119, which is embedded in cylinder head 112. Assembly 103 consists of cylinder head 112 along with valve 107, bushing 119, and also a valve spring 108 and mating valve surfaces 110 (on the valve proper) and 111 (as part of 112). Spring assembly 102 counterbalances the force of spring 108 and adds restoring force to the armature. Assembly 102 includes a double-helical spring 109, as described by Seale et. al. in U.S. Pat. No. 6,341,767, "Spring for valve control in engines." The balance of forces from springs 108 and 109 strongly restores armature 113 to an equilibrium position approximately midway between the upper and lower yokes. Pulling the armature to one of the yokes may require resonant excitation, since magnetic saturation may severely limit pull-at-a-distance on the armature. When the armature is vibrated until it comes close to a yoke, the short-range pull is sufficient to land and latch the armature on one side. In subsequent operation, the armature is released from its latched position, travels quickly to the opposite yoke, and is pulled in and landed on that opposite side. An important application of the invention taught here is coordinated control of this releasing, pull-in, and latching of the armature on alternating sides. Related objectives are to achieve low-impact landings, to conserve energy, extend the life of the components, and minimize noise.

Figure 2:
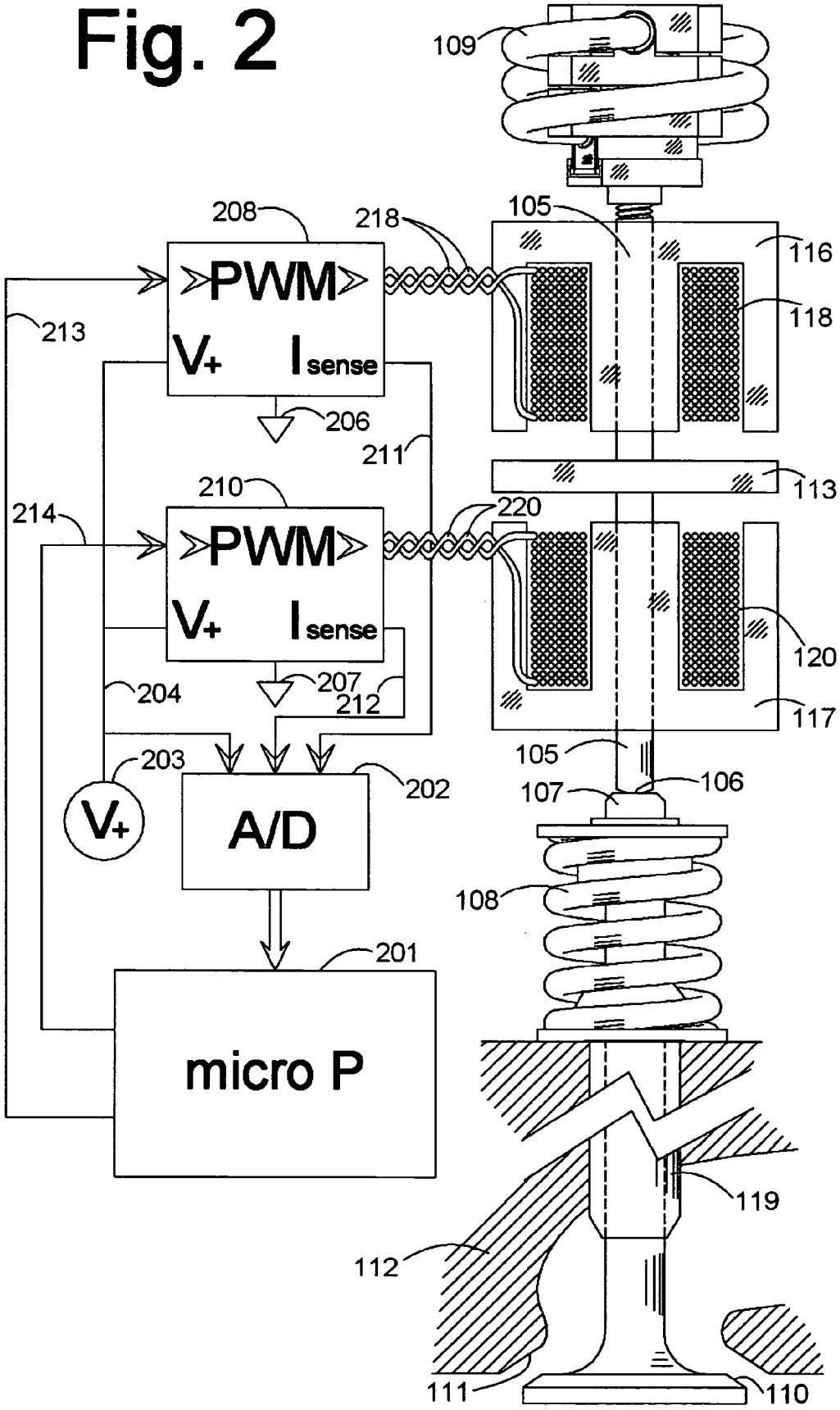
FIG. 2 is a schematic of controller inputs and outputs in relation to the solenoid of FIG. 1.

A typical dual-latching system topology is shown in FIG. 2. As drawn, a power supply 203, "V+," operating via branching conductor 204, powers two Pulse Width Modulation or PWM driver circuits, 208 and 210, which are shown connected via wire pairs 218 and 220 to the windings 118 and 120 on upper and lower solenoid cores 116 and 117. These cores act on a single armature 113, as in FIG. 1. A valve 107 and springs 108 and 109 like those of FIG. 1 are also indicated in FIG. 2. Each of PWM driver circuits 208 and 210 is controlled by an output, 213 and 214 respectively, from a microprocessor 201, indicated as "micro P" in the diagram. Each PWM driver also has a ground connection (206 and 207) and a current sense output (211 and 212) going to an Analog/Digital (A/D) converter channel in converter 202, which is connected to or is part of the microprocessor 201. The power supply voltage is also connected, via a branch of 204, to an A/D channel in 202, normally with scaling resistors (not shown) to match the A/D input range. The microprocessor receives the converted digital signals from the multiplexer and A/D section 202 (which is typically included as part of the microprocessor chip) and sets duty cycle values to the PWM drivers. Power supply, ground, and external data interface connections to the microprocessor are not shown in this diagram, which concentrates on the relationship of the microprocessor to the solenoid. The remainder of this specification describes the operation of a microprocessor or Digital Signal Processor (DSP) chip in a controller like this, or in any comparable controller in which the microprocessor receives sufficient input information to determine armature position and a measure of armature velocity with respect to at least one attracting magnetic yoke, and whose output controls an electrical drive signal, such as a PWM duty cycle, that ultimately regulates the current and magnetic flux in the yoke. The system may include separate sensors and A/D inputs for magnetic flux or field strength, or position, or velocity. In an embodiment to be described, flux linkage and position and velocity are inferred from PWM settings, supply voltage, and sensed current.

In the operation of primary interest for this invention, a magnetic yoke pulls the armature from a distance, drawing it to a latching position very close to or in contact with the yoke. In an important dual-latching embodiment illustrated in FIGS. 1 and 2, with two separate magnetic yokes, a spring system restores the armature to a position roughly midway between the yokes. The functions of the controller include coordination of the release of the armature from its latching against one yoke, followed by pull-in of the armature for a low-impact landing, and finally latching of the armature to the opposite yoke.

In the illustrated dual-latching embodiment of FIGS. 1 and 2, the armature is coupled to a cylinder valve in an internal combustion engine. Microprocessor sense inputs permit tracking of the position of the armature in relation to the two yokes over time, and the control outputs are used to control the tracked position and bring about low-impact landings near to or in contact with each of the two magnetic yokes. When an armature approaches a magnetic yoke, there may be a two-step landing, consisting of the seating of the valve 107 (when surfaces 110 and 111 meet) following the armature, followed by seating of the armature itself in contact with the latching magnetic yoke. The armature motion may stop as the valve seats, then continue to move to contact with the yoke, opening up a small lash-adjustment gap between the armature system and the valve. Thus in FIG. 2, the constant-diameter shaft descending through and below the lower yoke is illustrated with a slightly rounded end touching the top of the valve. When the armature comes close to the top yoke, the valve will seat with a first controlled landing. This landing will arrest the motion of the coupled actuator and valve and then allow the armature shaft to pull away from the closed valve and progress to full magnetic closure. The upward force of the valve spring will decouple from the armature shaft, and the solenoid will have to pull harder than before to continue the upward motion of the armature toward its second landing in contact with the yoke. The procedures and methods described below can control single landings or sequential double landings of the type just described.

In the broad system context just outlined with variations, and now focusing on control of magnetic pull-in of the armature to low-impact landing against a yoke, stored state-space landing trajectories embody specific, quantitative information about solenoid characteristics, as well as information about various interacting loads such as gas forces on a valve. These trajectories define multiple paths to successful armature landings with low impact, low bounce, and with latching. The solenoid uses stored controller information describing multiple possible trajectories that fit the performance of the particular solenoid. This trajectory information may derive from a combination of testing, characterization, and simulation of the solenoid or a similar solenoid. Alternatively, the trajectory information may derive entirely from instrumented testing, with landing and latching, over multiple actuation cycles tracing multiple trajectories through the state space of the system, for the controlled solenoid or for another similar solenoid subjected to extensive testing. Finally, the system may derive or refine its trajectory information during regular operation in the targeted control environment.

The nature of the trajectory control information is now defined. Central to the trajectory information is a state space in three dimensions:

winding flux linkage (or winding current, or magnetic force);

armature velocity (or armature momentum);

armature position;

Alternative definitions are allowed, as indicated in parentheses, carrying equivalent information. If the mass of the armature, including any coupled load such as a valve and effective moving spring mass, is fixed and known, then armature momentum may be specified in place of armature velocity, leading to the kind of phase space definition that might be preferred by a physicist. A velocity indicator may be substituted for the armature velocity, for example, a change in measured armature position from a most-recent to a next-most-recent determination of position, or a more complex measure involving multiple positions from the past, or a valve release delay (as discussed later.) If armature position and the yoke winding current are both defined directly by sensors, then the winding flux linkage and the winding current bear a known relationship for a solenoid of known characteristics. Winding current may thus be substituted for winding flux linkage, providing equivalent information. Similarly, position and flux linkage imply magnetic force, and conversely, position and force imply flux linkage, so magnetic force may be substituted in the first of the three state space dimensions.

In a "down-wire" system like one taught by Bergstrom (op. cit.), flux linkage is tracked dynamically by integration of an inductive voltage, and flux linkage and current together are used to define position without the use of a separate position sensor. In such a system, the armature velocity becomes a velocity indicator, specifically, an average velocity computed as a difference between positions inferred at different times from flux linkage and current. The microprocessor interface illustrated in FIG. 2 provides the means to sense current and means to determine inductive winding voltage from supply voltage, PWM setting, and circuit resistance. The control system can infer corrections to the value of circuit resistance based on consistency checks from measured system performance.

A solenoid is described with useful accuracy by a third order system of differential equations, for which the three state variables listed above provide a complete state description. The effect of drive voltage from the controller is felt most immediately at the "top" layer of the state variable list, namely the flux linkage, or a variable carrying equivalent information. After applied voltage is corrected for resistive and other losses, the remaining voltage is an inductive voltage, driving the time derivative of the flux linkage. The differential relationship between voltage and flux linkage is therefore first order. In a practical engineering control context, magnetic force responds more or less instantaneously to flux linkage, so that the differential relationship between flux and force is modeled as zero order, an algebraic rather than a differential equation. Changes in magnetic force cause matching changes in the time derivative of armature momentum, yielding a first order differential relationship of force to momentum and a second order relationship of drive voltage to momentum. For a typical system characterized by a constant moving mass, the relationship between momentum and velocity is zero order, that is, momentum and velocity are related without time delay, so momentum and velocity both lie in the second "layer" of differential relationships. Velocity defines the time derivative of position, a first order relationship which places position in the third "layer" of differential relationships in this third order control system, relative to drive voltage in "layer" number zero. Other couplings such as damping force complicate the derivative relationships slightly, but it remains true that flux linkage responds to drive voltage with first-order delay, velocity responds with second-order delay, and position responds with third-order delay. This natural hierarchy leads to a controller design in which a feedback system sets a flux linkage target from high-order relationships embodied in pre-computed trajectories, following which a control computation sets output voltage (or PWM setting) to give a linear extrapolation of flux linkage to a target value in a predetermined short time period.

In a real ferromagnetic yoke and armature, eddy currents will arise in response to the rate of change of flux linkage, and in response to changes associated with the geometric redistribution of flux as the armature moves. These eddy currents respond more or less instantaneously to changes in applied winding voltage. While eddy currents temporarily cancel changes in yoke winding current, they cause measured current to fail to reflect the effective overall current that controls magnetic flux, and therefore force. Inductive voltage, as measured or controlled in a drive winding or a separate sense winding, reflects the true rate-of-change of magnetic flux linking the winding. Flux linkage, computed as the integral of inductive voltage, can be used in combination with true position of the armature to derive a fairly accurate measure of magnetic force, with minimal sensitivity to eddy current influences. If winding current and flux linkage are used together to compute position, then an accurate dynamic determination of position may need to rely on an eddy current correction.

A simple approximate eddy current correction uses a "shorted turn" model, treating the net effect of eddy currents as equivalent to having a shorted winding turn with a known resistance. In this model, the inductive voltage in the shorted turn is the same as the average inductive voltage per winding in the drive coil. The eddy current ampere-turns are therefore proportional to inductive voltage divided by a net eddy current resistance. When this eddy current correction is added, with appropriate sign and weighting (accounting for the number of winding turns), to a measured winding current, then the corrected effective winding current, divided by the flux linkage, provides an improved measure of armature position. A more sophisticated model may add a second "shorted turn" around the armature. The rate-of-change of flux linked to the armature depends on the rate-of-change of flux linkage in the yoke winding, and also on the rate-of-change of the gap distance, X, controlling the linkage of flux from yoke to armature.

Magnetic hysteresis represents another perturbation to the solenoid model under discussion. If flux linkage increases monotonically during the closure of the magnetic gap between an armature and yoke, then the effect of magnetic hysteresis is like the effect of a fixed eddy current opposing the winding current. As magnetic coupling to the armature increases with gap closure, the hysteresis effect will increase systematically as a function of the decreasing gap, even as the air-gap magnetic reluctance falls. For control purposes, a hysteresis correction may consist of a simple offset correction to the apparent magnetic gap, which at small values will be computed as slightly larger than the physical gap separating the armature and yoke. In a mathematical simulation model, the effect of hysteresis can be lumped together with the effect of imperfectly mating surfaces of the armature and yoke and represented as a non-vanishing magnetic gap size when the armature and yoke reach physical contact.

If the flux linkage does not increase monotonically but reverses direction during a controlled landing, then the effect of hysteresis will be much more complicated. Parts of the yoke will see a reversal in the direction of change of magnetic field strength, while the armature and parts of the yoke strongly coupled to the armature may see no reversal in the rate-of-change of field strength, since the decreasing magnetic gap may predominate over the winding flux-change reversal. There is a strong spatial interaction between eddy currents and magnetic hysteresis, requiring nonlinear differential equation models for accurate representation and controller correction. Maintaining a simple controller, therefore, it is advantageous to seek a monotonic increase in flux linkage as an armature is pulled in for low-impact landing and latching. The state space control models to be illustrated below reflect this rule of maintaining a monotonic change in flux linkage. Non-monotonic flux change, corresponding to a change in the sign of inductive voltage, may be used late in a trajectory toward landing, when a short time-to-landing limits the effect of control actions and when the system may need a strong push toward reduced flux linkage to minimize an anticipated hard landing. In the absence of a rapidly-computed nonlinear model of hysteresis and eddy currents, however, information about the magnetic state of the controlled system will become less accurate if the inductive voltage changes sign, especially in the case of wide positive and negative swings in drive voltage. Thus, a last-moment reversal in the sign of inductive voltage may "blind" the system to later refined course corrections, but such a reversal may nevertheless be useful for correcting an error just prior to landing.

Ignoring eddy current and hysteresis effects, the three-variable state space description given above defines a vector field in three dimensions. Position is defined along a first axis, call it "X". Velocity is defined along a second axis, "Y". The value of the Y coordinate defines how fast the system is moving along the X coordinate. A family of such position and velocity traces is illustrated in FIG. 7. The derivation of this family of traces will be explained later with reference to FIGS. 3, 4, 5, and 6. In the traces of FIG. 7, the spring neutral position is the midpoint 708 of the X axis 701 and is indicated by an oversize tick mark on the axis. If the armature were pulled all the way to the maximum value of X at the right end of the graph, at 705, and were then released to travel without friction and without any magnetic pull, then the trace of velocity "Y" (along axis 702) versus position "X" (along 701) would describe an ellipse starting on the extreme right, reaching a maximum Y in the middle, and ending on the extreme left at 706. At each point along the ellipse, the square of the off-center distance "X-Xctr", multiplied by ½ and by the spring rate K, gives the spring potential energy. The Y-axis velocity, multiplied by ½ and by the effective moving mass M, gives the kinetic energy. A constant sum of these two energies results in an elliptical trace. In the traces actually shown, the armature is released mechanically with various deflections less than 100% on the right, varying from minimum deflection 703 to maximum deflection 704, and then pulled electromagnetically to a low-impact landing at 100% deflection on the left, at 3-dimensional point 707. Low-energy trajectory path 711 starts at minimum deflection point 703, while high-energy trajectory path 710 starts from the maximum deflection point 704. For these outer paths, and for the seven computed intermediate paths, and for all paths lying between these computed paths, the electromagnetic force acting on the armature must make up the deficit in potential energy represented by releasing the armature from less than 100% deflection. In a valve control system, the energy deficit would be generated by a combination of pull from the releasing solenoid, friction, and gas forces that may impede the opening motion of a valve. A controller goal in the present case is to use the magnetic pull of the releasing solenoid, as exerted immediately following release, to reduce differences in mechanical energy that are being caused by varying gas pressure forces acting on the valve. Successful low-impact landing can only be accomplished, on the pull-in side, over a limited range of mechanical energy of the approaching armature and its load, so corrections from the releasing side are useful to narrow the variation in incoming energy on the pull-in side.

Returning to the characteristics of state space diagrams like that of FIG. 7, if a tangent line to a trajectory is parallel to the X axis, then Y is unchanging, velocity is constant, and acceleration is zero. The slope of the trajectory in X and Y, dY/dX, is related to acceleration dY/dt, by Y=dX/dt. Hence, acceleration=Y·(dY/dX). Recalling that acceleration=F/M for force "F" and mass "M", we may write dY/dX=F/(M·Y). Thus, the slope of a state space trajectory projected onto the (X,Y) plane is determined by the net force affecting armature travel, including spring force and magnetic force.

Figure 7:
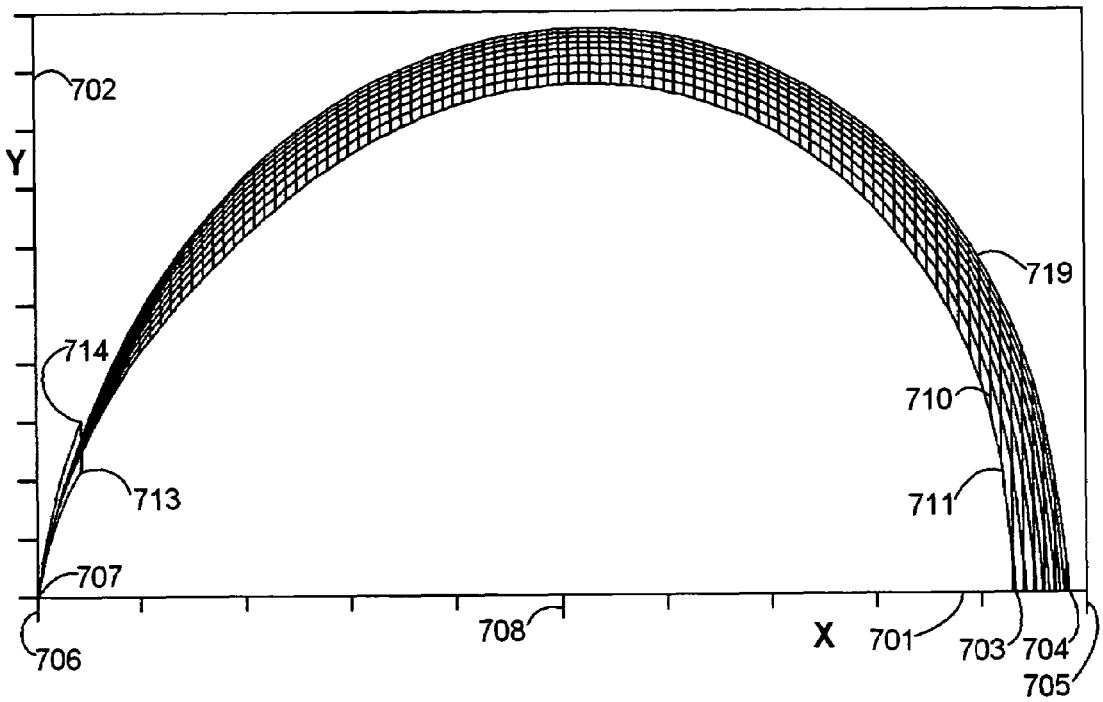
FIG. 7 is a family of curves of velocity versus position derived from simulations like those illustrated in FIGS. 3, 4, and 5.
Figure 8:
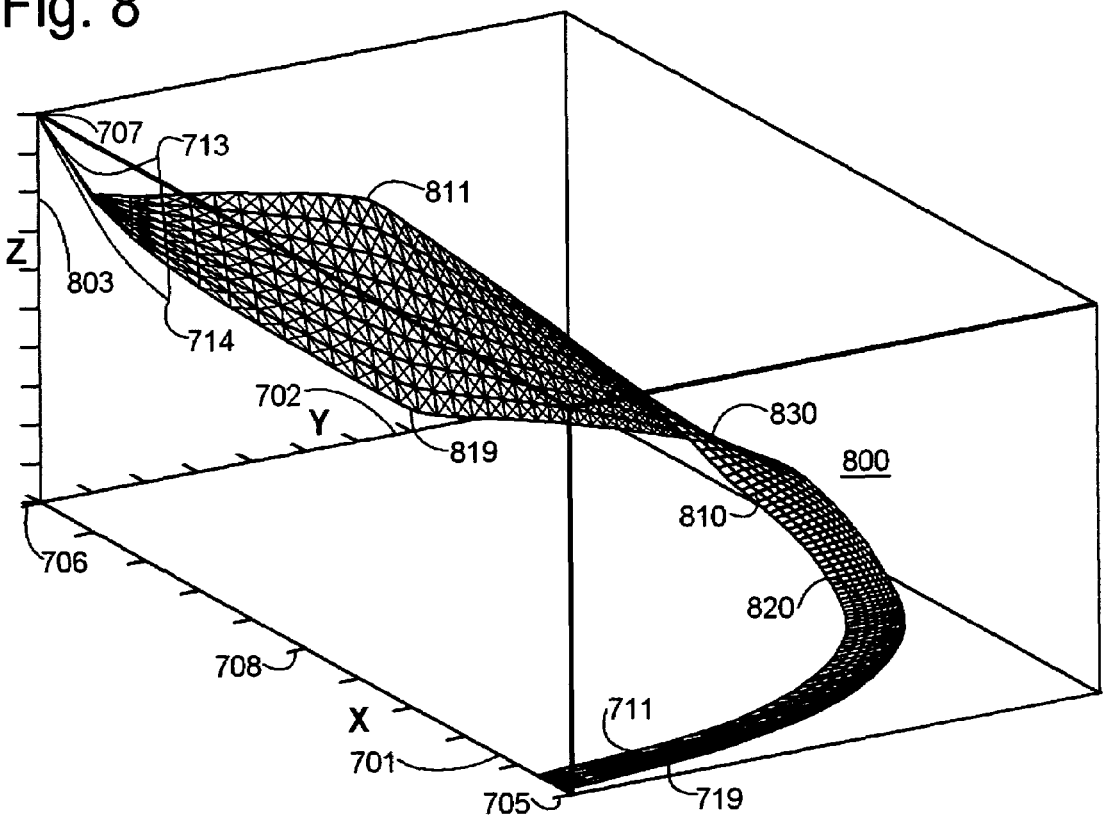
FIG. 8 shows a state space control surface generated from multiple trajectories and showing flux linkage as a function of position and velocity.

Moving to the third dimension, set Z=flux linkage. In FIG. 8, the nine trajectories following roughly ellipsoidal paths in FIG. 7 are raised up in the Z dimension, along axis 803, to indicate the flux linkages that were required to produce the magnetic forces resulting in convergence of all the trajectories to a single trajectory going to low-impact landing at point 707, which in three dimensions is seen to lie above point 706 on the end of the X axis. These nine trajectories, along with crossing lines (such as line 710) parallel to the Y axis and equally spaced in X, form a grid shown flat in FIG. 7 and raised up in FIG. 8 to define a surface in coordinates (X,Y,Z). Magnetic force "Fm" varies as the square of Z multiplied by a function of X, while total force "F" depends also on spring force, which is a function of X. Thus, projected into the (X,Y) plane, the slope dY/dX of each trajectory includes a spring force term that varies as a function of X, plus a magnetic force term that varies as a function of X and Z. When the trajectory is projected into the (X,Y) plane, therefore, the projected trajectory slope dY/dX is defined by the (X,Y,Z) position in the state space, before the effect of any control action. The effect of control action is to alter the rise or fall of each trajectory in Z. This alteration in Z, in turn, changes the trajectory slope as projected into the (X,Y) plane.

When an applied voltage "Va" acts across the solenoid winding, the inductive voltage "Vi" is determined by subtracting out a loss term, "IR", yielding Vi=Va−IR. The loss term may be the simple product of current "I" times a linear resistance "R", or the term "IR" may include voltages from nonlinear components such as diodes. The applied voltage "Va" may be the product of a power supply voltage and a duty cycle or PWM (Pulse Width Modulation) value. In any case, the controller is designed to control the inductive voltage Vi, adjusting the PWM or applied voltage appropriately in relation to predictable voltage losses, to establish the desired inductive voltage. The controlled inductive voltage sets dZ/dt, the rate of change of flux linkage with respect to time. Recalling that Y=dX/dt, it follows that dZ/dX=(dZ/dt)/Y. Thus we see that in the (X,Z) projection of the trajectory, the slope dZ/dX, is controlled by inductive voltage. In the state space, therefore, control is exerted directly and instantaneously on the slope of the coordinate Z above the (X,Y) plane. As the trajectory evolves over time and Z changes in response to control, the changing height alters the slope dY/dX of a tangent line to the trajectory, as projected onto the (X,Y) plane.

Going beyond mathematical description of hardware implementation, the numeric description of this surface, and the system for information retrieval therefrom, becomes a functioning path memory. The solenoid controller evaluates the changing physical state of the solenoid, defining a moving point in state space. From the path memory, the controller defines a path number for the stored path that is, by some measure, closest to the evaluated physical state. That measure of distance to the closest path becomes an error to be reduced by feedback control, so that the controlled, dynamically varying system state ideally comes to follow a path from the path memory. As described here, the "closest path" is defined as the path crossing the same (X,Y) ordinates as the current system state, and the distance to that path is the error in Z, for example, the error in flux linkage, or some similar error in the electromagnetic state of the solenoid. In an adaptive system, there will be identifiable patterns of energy gain or loss, or path perturbation, or path number drift, as will be seen in greater detail below. The content of the path memory may be a single surface, such as the flux linkage "strip" of FIG. 8, or an inductive voltage "strip" as will be described in reference to FIG. 9, or a surface defining winding current. An embodiment to be described below uses both a flux linkage surface, for defining voltages over intervals projecting into the near future, and a winding current surface, for computing resistive voltage losses anticipated in the near future. When patterns of path perturbation are identified, the path memory may describe control surfaces arrayed with respect to one or more path perturbation or drift parameters. In this case, a particular perturbation or drift parameter must be specified, selecting a subset of the path memory content, before the system goes on to define a path number for a unique "closest" path to the measured system state. Changing operating conditions then come to be associated with different perturbation or drift parameters, and adaptive control is accomplished by selecting a path drift parameter that selects a path of minimum drift. Thus, through selection of a path number and a path drift parameter, the path memory comes to embody a highly system-specific "projector" for the future trajectory of the system through state space, projecting from the present measured state and the present selection of a path-drift-minimizing parameter. This "future projection" involves a combination of prediction and purposeful control, to "know" what future states are accessible from the present system state, and to "control" which accessible state is actually reached—desirably, a state that directs the system to a low-impact landing target with the force balance needed for latching. From among the unbounded variety of paths that might be defined in the path memory, the very limited (but nevertheless potentially large) subset actually residing in that memory is a set of paths that arrive at a pragmatic destination—low-impact landing with latching—while obeying system constraints.

In phase space descriptions used by physicists to describe trajectories of uncontrolled systems such as planetary motion, the rules governing the trajectory are fixed. In the present controller state space description, the tangent directions projected into the (X,Y) plane are fixed functions of the coordinate location (X,Y,Z), but the tangency slope in Z is under limited control. The limitation is imposed by bounds to the applied voltage, setting a slew rate limit or slope limit for change in Z. In order to avoid the control uncertainties introduced by hysteresis, dZ/dt is usually constrained to be positive. Magnetic saturation imposes a ceiling on Z, that ceiling typically varying as a function of X. Finally, a defined state space trajectory is entered after the armature is released, with the velocity at a given position shortly after release being influenced by the system load as well as by controllable magnetic forces reducing the kinetic energy of the releasing armature. The system load can include large forces to open an engine valve against a contained cylinder pressure. Both the system load and the magnetic release of the armature will influence the total kinetic energy of the armature as it passes the spring-neutral point between release and recapture. This range of kinetic energies will define a range of entry points into the state space region where control is to be exerted.

The state space control problem is to initiate control at a variable entry point into the state space, and to direct the system toward a specific target: (X,Y,Z)=(0,Y0,Z0), as indicated at point 707. At the landing point X=0, the target landing impact velocity Y0 is a small negative value—negative because the gap X must be decreasing at impact. When landing is achieved, flux linkage Z must be large enough to latch and hold the armature. If Z is less than the latching value at impact, Z will necessarily remain below the latching value for a finite time after impact, due to slew rate limitations. During the time required for Z to slew up to a latching value, the armature will pull away from the yoke and have to land a second time, if it does not pull away too far for recapture and latching. If Z exceeds the latching value at impact, it will inevitably have exceeded the latching value for a finite time before impact, during which time the magnetic force of attraction will have exceeded the spring force, accelerating the armature toward impact. To keep impact velocity very small, the flux coordinate Z must hit quite close to a target value, Z0. That value will be roughly the minimum flux linkage necessary to latch and hold the armature. Finally to insure that latching is maintained, the landing value Z0 should be approached with a positive slope, that is, flux should be increasing as the armature lands and should continue to increase for a while after landing, to latch the armature securely. Approach to landing with a relatively rapid rate of increase in flux leads to a relatively prompt landing. If flux is always increasing, the path of the armature will not usually "hover" near closure (unless, for example, rapidly changing gas forces may be acting on a driven valve.) In most control situations, it is desirable to move the armature as quickly as possible to its target, minimizing the uncertainty of its time of arrival.

The landing controller goal is to direct the system from multiple entry points to a single landing target in the control space, while change in Z with time is confined to be positive but less than a voltage-limited slew rate. The target can only be reached from a limited fraction of the state space. The relatively narrow width, in position and velocity, of the strip of trajectories shown in FIG. 7 and projected onto the (X,Y) plane of FIG. 8 provides a realistic idea of the limited subset of the state space from which low-impact landing paths are achievable. In those two figures, the traces converge to a target point (X,Y,Z) short of landing, and the converged traces proceed as a single trajectory to landing. In a real system subject to external forces and vibrations, plus measurement noise and discretization error, actual trajectories will generally miss such an interim target. Starting shortly before the interim target, therefore, a second set of trajectories is developed to fan out backwards from the landing point to the vicinity of the interim target, as indicated by the span of entry points between 713 and 714 in both FIGS. 7 and 8. These second-stage converging trajectories will "capture" incoming trajectories that missed the interim target by various errors and will "funnel" these trajectories to the final landing target. Trajectory paths in the control state space can be built up from any number of such overlapping layers of converging paths.

In the final composite control "ribbon" of converging trajectories, care must be taken not to let trajectories with widely differing flux values come too close together in the (X,Y) plane. If they come too close and the control surface in Z becomes steeply sloped, then noise and errors in the determination of position and velocity will cause the control voltage to fluctuate widely. In a sampled data system where an erroneous voltage is applied for a fixed period, large drive signal fluctuations arising from high noise amplification will cause worse errors than would be encountered in a system with lower feedback gain. High error-signal amplification is desired, however, for feedback correction of errors arising from unexpected external forces. Wide drive voltage fluctuations will also generate eddy currents and nonlinear magnetic effects that will deviate from the controller models and result in poorer control. Thus, as explained earlier, effective error gains along the trajectory need to be adjusted for a best tradeoff between noise errors and perturbing force errors. Therefore, the converging ribbon of trajectories of FIG. 8 should be supplanted, as that ribbon narrows, by a broader converging ribbon that carries the system closer to touchdown. As indicated by the increased span from entry points 713 and 714, a succession of overlapping, converging sets of trajectories may be used to design an effective composite definition of the control surface. Near landing, when the armature is so close to touchdown and moving so slowly that position and velocity sensing errors are comparable in magnitude to the gap size or the approach velocity, then meaningful course correction is no longer possible. In this case, the state space controller can continue to ramp up flux "open loop" along a computed trajectory extrapolated from the latest valid position and velocity information.

Examining features of the control strip in phase space 800, the strip in the (X,Y) plane bounded by paths 711 and 719 is seen to bend upward in the vicinity of 820, where voltage is first applied to raise the flux linkage, which is the height Z in this space. The reference lines like 710, paralleling the Y axis, remain roughly parallel to Y at raised reference line 810, but begin to tilt rapidly (into the Z dimension) at 830, where control action begins to correct the energy differences between the inner and outer paths. The resulting tilt of the control surface brings the underside of the surface into view, as indicated by diagonal lines cross-hatching the grid of path lines and lines of constant-X. The high-initial-energy path 719 proceeds to a relatively low flux linkage at 819, resulting in low magnetic attraction and low transfer of magnetic-to-mechanical energy, while the low-initial-energy path 711 proceeds to a much higher flux linkage at 811. The path from the high flux linkage at 811 continues with little increase in height, while the path from low flux linkage at 819 rises steeply in order to approach the required landing flux. As the first set of trajectories converge, control transfers to the second strip whose entry points span from 713 to 714. Observe that the upper regions of this secondary strip violate the "rule" of monotonic change in flux linkage, as may be required to correct large energy deficits. The hysteresis and eddy current problems associated with non-monotonic flux change have already been discussed. As drawn for illustration, some of the strip extending from 713 and 714 may be beyond a practical range of control, as slewing of flux linkage is limited by the range of controller output voltages.

Figure 9:
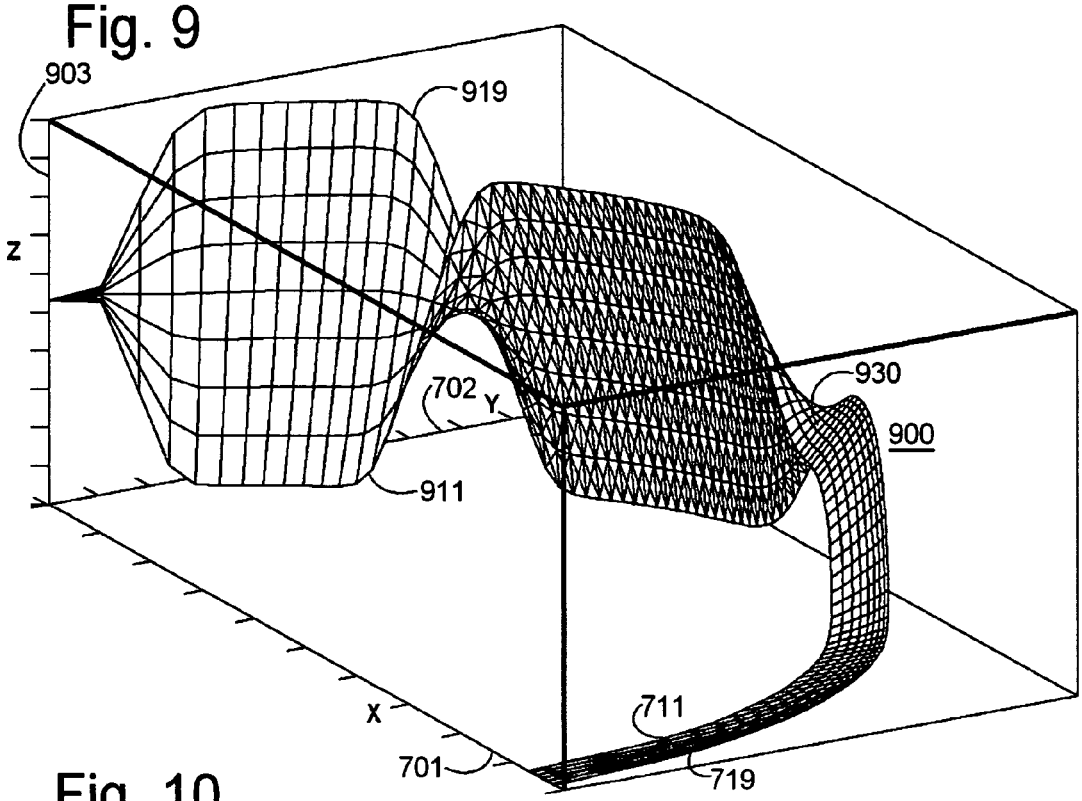
FIG. 9 shows a state space control surface related to the surface of FIG. 8, being a map of inductive voltages or, equivalently, of rates-of-change of the flux-linkage paths of FIG. 8.

The space 900 of FIG. 9 is closely related to space 800, with the strip therein representing the rate-of-change of flux linkage along "Z-axis" 903. In practical terms, this rate-of-change is the inductive voltage required to keep flux linkage on track. As in FIG. 8, the underside of the control strip of FIG. 9 is indicated by diagonal cross-hatch lines. The initiation of control feedback action at 830 is conspicuous at corresponding point 930 of FIG. 9, while the points corresponding to 811 and 819, here at 911 and 919, are seen to lie just beyond an abrupt warp in the surface.

The multiple trajectories of FIGS. 8 and 9 were generated using a computer simulation of the solenoid motion, but running backward in time, starting at the defined ending point (0,Y0,Z0) and moving back under various control regimes. By working backward and obeying the constraints of inductive voltage bounded between a maximum value and zero (to avoid magnetic hysteresis), one readily derives trajectories defining the fraction of the state space from which low-impact landing with latching is possible. Working back to the beginning of the various possible trajectories, a single constraint is imposed: that the armature flux linkage reach zero when the armature reaches some point distant from that yoke which is to pull in and latch the armature. This goal is readily accomplished in the backwards-time simulation by simply shutting down the drive voltage when the flux linkage hits zero. In an alternative approach to be described in more detail, a set of trajectories is generated with transitions in inductive voltage placed at fixed locations in X, including a fixed starting point for the ramp up of flux linkage. This is not the only approach to constructing control surfaces, but it has the advantage of creating a surface with relatively linear interpolations between points at different Y locations for a given X.

Figure 3:
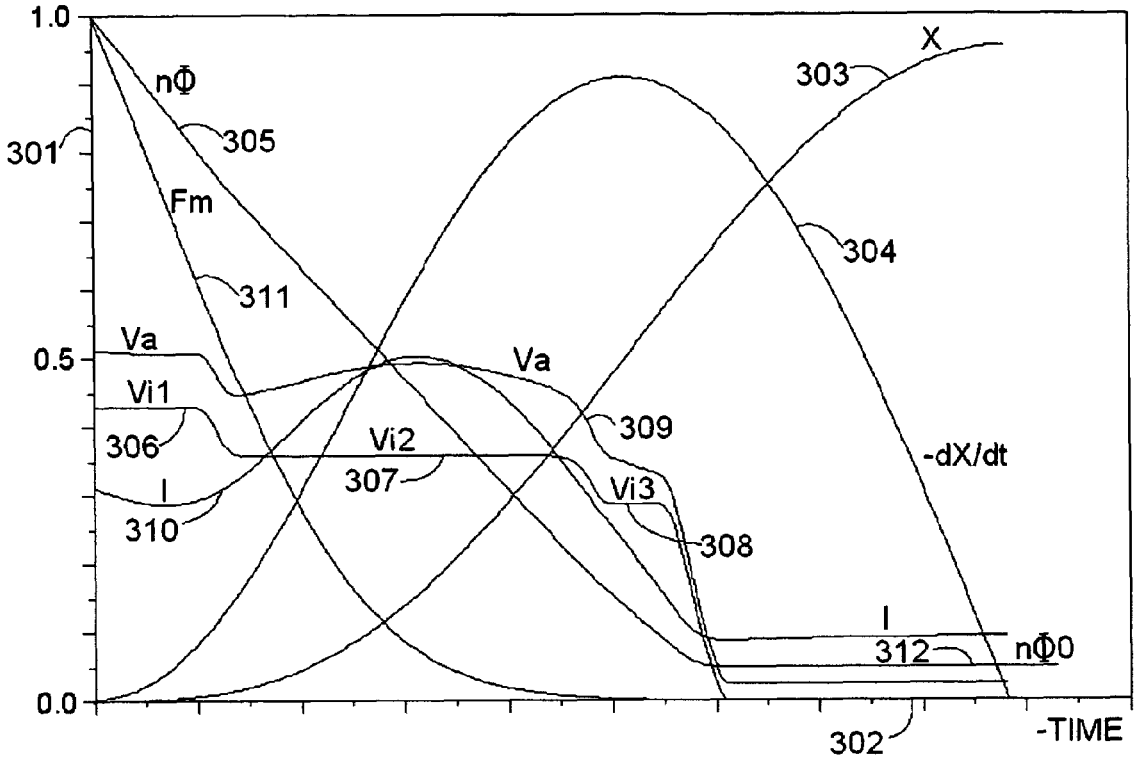
FIG. 3 is a family of graphs illustrating a time-reversed simulation of a solenoid trajectory.

FIG. 3 illustrates a time-reversed simulation of solenoid dynamics. Most of the traces are normalized in vertical scale (along axis 301) to equal 1.0 at a meaningful maximum value. The normalized magnetic force "Fm" on trace 311 hits 1.0 when the force matches and counterbalances the spring force at the latching point, where X=0. The flux linkage "nΦ" on trace 305 reaches unity at the value that produces the latching force in Fm with magnetic gap X=0. The position trace 303, "X," is scaled for a spring-neutral position at 0.5, with equal maximum but opposite spring forces at 0and +1. (The spring-neutral position need not be exactly centered. In an exhaust valve actuator designed to open the valve against high pressures, for example, the neutral position may be biased to boost opening, thus equalizing the pull-in work required of the valve-open-side and valve-close-side magnetic yokes.) The X trace starts on the right (its starting point in this time-reversed graph) at a maximum deflection less than 1.0, meaning without sufficient spring energy to get the armature to closure on the opposite side without magnetic pull-in. The trace of negative velocity 304, "−dX/dt", is scaled such that when the spring potential energy at maximum deflection is converted entirely to kinetic energy, then −dX/dt=1. The energy deficit to be made up by magnetic pull-in for lesser deflections is evident in the distance by which the velocity trace falls short of 1.0 at its maximum. Note that the fraction by which this velocity trace falls short of 1.0 is about the same as the fraction by which the position trace falls short of 1.0 if one recalls that the "baseline" neutral position falls at X=0.5, not X=0.0. Returning to the flux linkage trace 305, nΦ, the slope of this trace is inductive voltage Vi, which is labeled Vi1, Vi2, and Vi3 for three plateau regions to be explained. The applied voltage "Va" exceeds the inductive voltage by a resistive voltage called "IR", which can come from a linear resistance model or can result from a nonlinear model. One unit on the Va trace 309 is chosen to represent the power supply voltage, and therefore the greatest swing of applied voltage (before accounting for "IR" losses.) Finally, there is a trace for current "I" along 310, whose units are arbitrary.

In the simulation illustrated in FIG. 3, the system runs backwards in time (along axis 302) from a start at a very low landing velocity (not resolvable from zero in the graph), position X=0 representing the latching position, and normalized flux linkage and magnetic force at 1.0, the release threshold, which in backwards time is the capture threshold. The flux and force graphs extend upward beyond the left of the illustration, meaning that the controller is designed to exceed the minimum magnetic holding force immediately after landing.

One method of constructing the three-tier inductive voltage trace is described here. The objective, whose purpose will become clearer as the narrative continues, is to define a function of time (or of reversed time in this case) that begins at a programmable initial value; makes a smooth transition down by a prescribed amount centering on a prescribed first transition time; remains constant until a second downward transition by the same difference as before, this second transition centered on a second prescribed transition time; and at a third prescribed transition time makes a smooth ramp to zero. We will call this the one-way inductive voltage function, since the function takes two steps of equal size and in the same direction, going in reverse time from a predetermined starting level. The starting plateau, at 306 and level Vi1, is designed to place the total applied voltage Va close to a normalized 0.5, that is, roughly halfway to the positive power supply limit. The first downward transition is moved to the right on the graph (back in time) enough to permit a second course correction, which is to be overlaid on the control trajectory strip during the Vi1 interval. The final transition time to zero is set to land near to or a little before (to the right of) the forward time that position X crosses the spring-neutral region, which in the system under consideration is roughly the time when flux linkage needs to start ramping up. The short interval 308 at Vi3 is made just long enough for at least two valid position determinations based on the initial increases in flux and the corresponding current measurements. This fixes the time of the transition from Vi3 to Vi2, at which time an initial trajectory evaluation will have provided course correction information for region 307 of the trace. The "S" curves between Vi1, Vi2, Vi3, and zero are constructed, in the illustrated example, using the hyperbolic tangent function as a transition spline. Other functions can be constructed to give similar performance to this one-way inductive voltage function.

Figure 4:
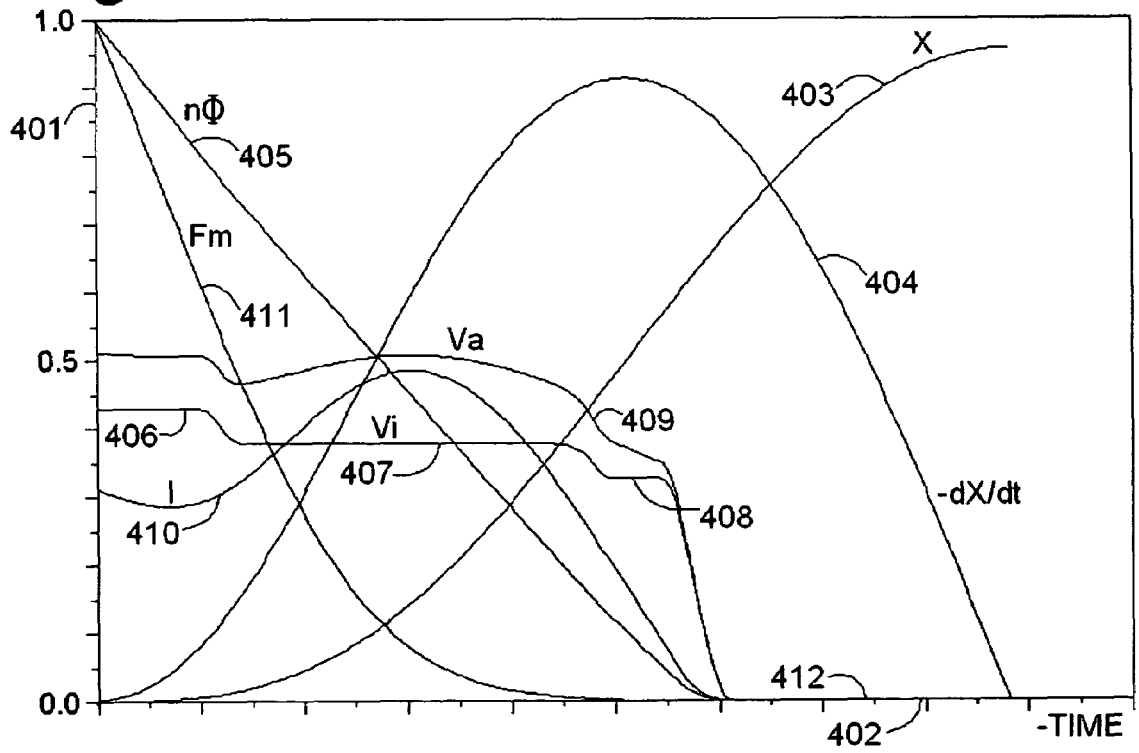
FIG. 4 is like FIG. 3 but with the inductive voltage trace adjusted for an initial condition.

The trajectory constructed in FIG. 3 has the desired landing characteristics, but the initial flux linkage 312 (seen at the right end of the reverse-time curve) is non-zero, taking on the initial value labeled at nΦ0 on the right of the graph. The system is intended to be initialized at a known condition of open magnetic gap, zero current, and zero flux. In FIG. 4, the size for the two equal transitions, from Vi1 to Vi2 and from Vi2 to Vi3, has been reduced slightly, by iterative solution, maintaining a higher average inductive voltage and therefore ramping the flux linkage by the correct amount to reach zero just as the inductive voltage Vi reaches zero. The identifying numbers 401 through 411 of FIG. 4 correspond to the numbers 301 through 312 of FIG. 3, but under the slightly altered conditions of FIG. 4. The initial flux 312 has been reduced to zero at 412.

The inductive voltage trace has been described as a function of time. Before varying this trace to define other trajectories, it is redefined as a function of position, based (for example) on the shape of the position curve "X" of FIG. 4. The time and inductive voltage coordinate pairs (t,Vi) are combined with the time and position coordinate pairs (t,X) to give a parametric definition of inductive voltage, namely (X,Vi). In subsequent trajectories, the voltage plateau levels and transitions may be defined by interpolation from data pairs of the form (X,Vi), fully defining inductive voltage as a function of position, rather than of time.

A second function, called the two-way inductive voltage function, is now defined as a perturbation to the original Vi trace. Going backward in time (that is, from left to right on the reversed-time graphs), this function goes smoothly from zero to a positive value, then to a negative value of the same magnitude, then back to zero. The transitions away from and back to zero are centered about the same locations as the transitions from Vi1 to Vi2 and from Vi2 to Vi3. The middle transition from positive to negative is centered in time midway between the other two transitions. Like the original one-way function, this two-way function can be constructed from hyperbolic tangent functions or other functions of similar shape. This two-way function of time is similarly transformed to a function of position. The transition times for this perturbing function to inductive voltage are made equal to the transition times of the original inductive voltage function.

Figure 5:
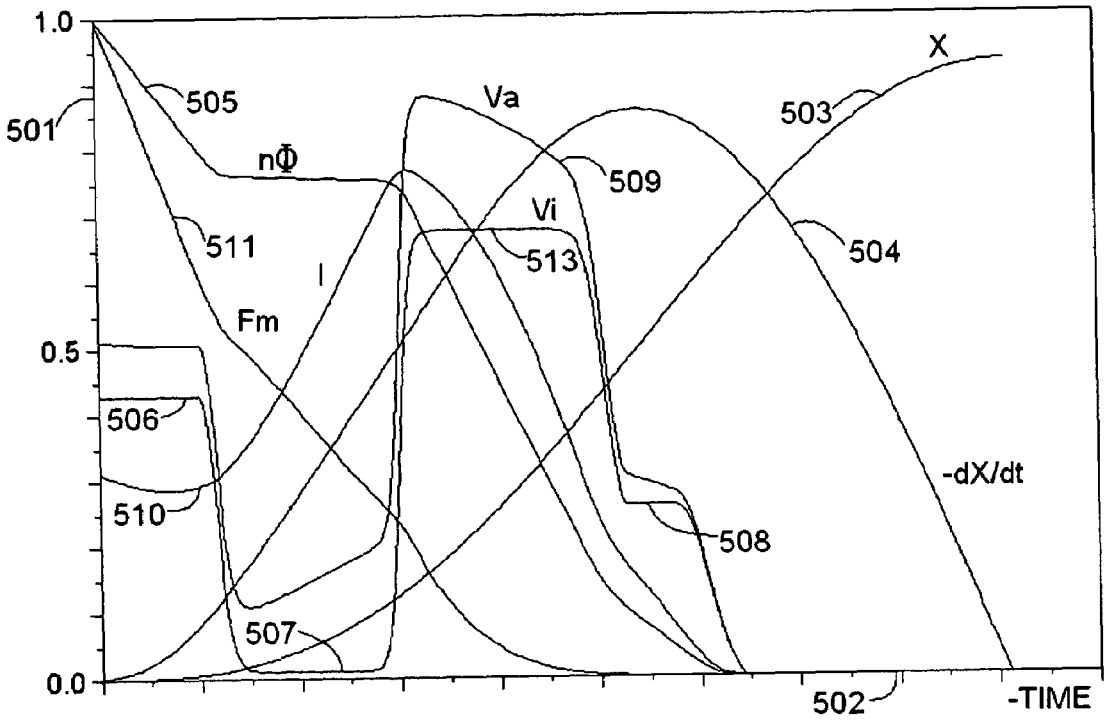
FIG. 5 is like FIG. 4, but the simulation is adjusted for low initial solenoid mechanical energy.

FIG. 5 illustrates the effect of the two-way function just described, in this case with a negative amplitude, going negative on the side closer to landing at 507 and going positive on the side farther from landing at 513. When the two-way function is applied, the position trace goes to a lower starting offset X, corresponding to a lower energy. Thus, the trajectory paths under this condition are suited for guiding a real trajectory starting with a low kinetic energy. Observe that the magnetic flux is brought to a high level sooner (in forward time) for FIG. 5 that for FIG. 4, with the flux then remaining high to provide a strong force of attraction on the approaching armature, making up an energy deficit. The magnetic force curve Fm is seen to rise higher in FIG. 5 than in FIG. 4. The shape and timing of the position response curve is altered, which moves the inductive voltage transitions slightly in time, since these transitions are now tied to position, not time. The time distortion alters the integral area under the inductive voltage curve, so that the flux trace no longer goes to zero on the right, without further correction. A correction is applied iteratively to the step sizes of the one-way inductive voltage function, to force the flux on the right hand portion of the graph to a zero value, as was done in going from FIG. 3 to FIG. 4. The traces shown in FIG. 5 incorporate the convergence of this iterative correction to the one-way function. As before, the trace numbering sequence from 501 to 512 in FIG. 5 corresponds to the equivalent trace numbers from 401 to 412 of FIG. 4 and from 301 to 312 of FIG. 3. A difference is that the level inductive voltage regions 307 and 407 give way to the high and low voltage regions 507 and 513, where 513 has no counterpart in the numbering of FIGS. 3 and 4.

Figure 6:
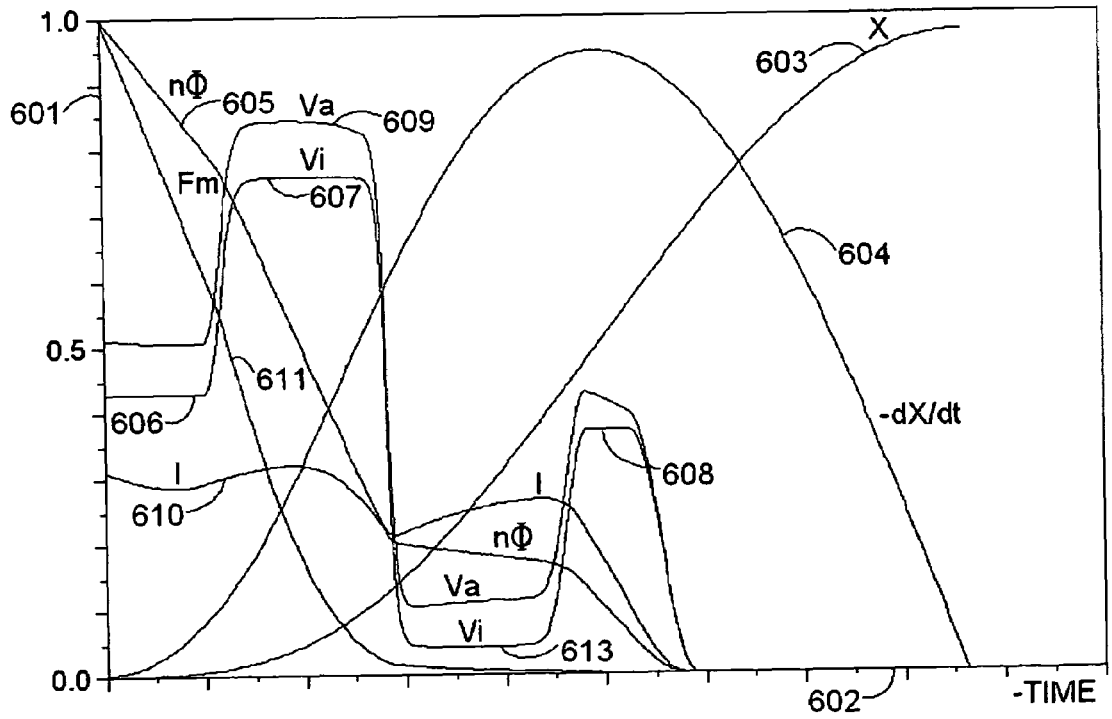
FIG. 6 is like FIG. 4, but the simulation is adjusted for high initial solenoid mechanical energy.

FIG. 6 illustrates the effect of the two-way function applied with the opposite polarity and a different amplitude. The trace and axis numbers 601 through 613 correspond to numbers 501 through 513 of the previous figure, with the change that the inductive voltage plateau 607, closer to landing, is now high, while plateau 613, farther from landing, is now low. Observe that the resulting trajectory is appropriate for guiding an armature coming in with high energy. Magnetic flux and attraction are maintained quite low for much of the forward trajectory (from right to left), then raised quickly toward the end, so that there is less average magnetic attraction and less energy transferred to the incoming armature.

The two-way function amplitudes for FIGS. 5 and 6 are adjusted to approximate the extreme conditions allowable without causing inductive voltage to go negative and without causing the applied voltage to exceed the supply voltage. These two trajectories become the inner and outer bounds of the state space strip illustrated in FIGS. 7, 8, and 9. From FIG. 5, plotting the flux linkage "nΦ" trace 505 as a function of two variables, namely the position "X" trace 503 and the negative velocity "−dX/dt" trace 504, yields the low-initial-energy path 711 extending upward to 811 in FIG. 8. Similarly plotting the inductive voltage "Vi" trace with numbers 508, 513, and 507 against 503 and 504 yields the path 711 extending to 911 in FIG. 9. From FIG. 6, traces 605, 603, and 604 yield the high-initial-energy path 719 extending to 819 in FIG. 8. Plotting the "Vi" trace with numbers 608, 613, and 607 against 603 and 604 yields the path 719 extending to 919 in FIG. 9. The intermediate trajectories are constructed using equally spaced amplitudes of the two-way inductive voltage function, going between the extremes associated with FIGS. 5 and 6. In each case, the step size of the one-way inductive voltage function is chosen to force the flux trace to zero on the right of the graph.

The state space volume that contains all possible trajectories reaching the desired target is a narrowing, curving tube, or cornucopia shape, with the tip of the cornucopia at the landing target. If the system is found anywhere within this tube, it can be directed to a controlled landing. One conceivable control approach is to direct the system toward a single trajectory roughly in the middle of the tube. A problem is that the controller can only directly affect dZ/dt or, equivalently, the trajectory slope of Z with respect to position X. Error with respect to a single target trajectory line will be two-dimensional, with errors in Y and Z at a given position X. To approach the trajectory line with only one-dimensional control of inductive voltage therefore demands a strategy extended in time. The general strategy is to change flux linkage in one direction to correct an excess or deficit in velocity relative to the target line, then to bring flux linkage back toward the value of the target trajectory as the velocity also approaches the target trajectory. Since the flux linkage is changed only at a limited positive rate bounded by power supply limits, the controller cannot bring velocity over to the target trajectory track and then abruptly bring the flux linkage to the target track. A complex strategy in time is required.

The procedure of generating a family of trajectories in reverse time fulfills the need just described. The ribbon of trajectories lies within the curving tube of possible trajectories to successful landing. At any position and velocity point (X,Y) in the space, the flux linkage target Z is defined. If the system trajectory falls within the tube of possible convergence but above this strip, then inductive voltage is reduced but maintained positive (to avoid hysteresis), until the trajectory reaches the strip from above. If the trajectory falls below the strip, inductive voltage is increased within power supply limits until the trajectory reaches the strip from below. For course corrections in the vertical or Z dimension of the state space, representing flux linkage, the system response is first order and linear, requiring control over a single variable (Z), rather than time-coordinated control over two variables (Y and Z). During the time that the trajectory converges toward the target strip from above or below, the system will slide laterally in (X,Y) with respect to the strip, but as it approaches zero error in Z, the trajectory will align parallel to the strip trajectories, due to the inherent directionality of the state space. The target strip itself consists of interpolated trajectory lines, each with a defined direction along the strip. If the system track is not perturbed by unexpected or unmodeled forces, the track will follow one of the tracks of the target strip. Lateral drift across the lines of the target strip will indicate a combination of two errors:

The target strip model does not accurately reflect the controlled system; or,

The system is being perturbed by unmodeled external influences.

These two errors may sound semantically equivalent, but they differ in emphasis. In the first instance, systematic tracking errors may lead to automatic corrections of the system model. These corrections can offset perturbing effects of temperature change, lubricity change, mechanical wear, etc., as well as repeatable external influences such as consistent flow patterns around a valve. In the second instance, tracking errors may provide immediately useful insight into changes in the solenoid load, for example, flow forces acting on a controlled engine valve. As was indicated in the summary section of this specification, a consistent trend of the tracking system to drift laterally across the trajectories of the target strip can indicate an ongoing gas flow across the controlled valve, information that is predictive of later and, for closing valves, rapidly increasing perturbation effects leading to landing errors. Because of the sluggishness of a third order solenoid system responding to its voltage drive input, and further because of response delays in a sampled data system controller, force perturbations late in the trajectory require correction with anticipation, by altering the voltage drive early enough that the force error is offset at it arises. Under strong and unanticipated gas flow conditions, this is the only strategy that will achieve a very low impact velocity with simultaneous balance in the latching force.

To plan this strategy in advance, an approach used in the development of this invention was to develop a dynamic solenoid system simulation that included an approximate model of gas dynamic forces around a valve. The detailed accuracy of this gas dynamic model was not as important as was a proper indication of trends—that an early course perturbation of a certain magnitude predicts a later course perturbation in a defined proportion to the early perturbation. When a valve closes and cuts off an ongoing fluid flow momentum, the valve will experience an abrupt force just as it closes. The most important control issue is to anticipate the magnitude of this abrupt force impulse, as a function of an earlier drift magnitude. In the common case where a valve is closing against an inflow of gas, then the force impulse can cause the valve to bounce more open before closing, either failing to latch or returning to close with impact as the magnetic field builds up beyond the latching threshold. In this case, the valve needs a little extra momentum as it approaches closure, just enough to overcome the opposing force impulse and reach a soft landing.

A more difficult situation is a late-closing intake valve that interrupts an outward flow of gas as it controls the volume to be retained for compression and combustion in a throttleless engine. Here, the valve needs to be slowing early, appearing to come up short of full closure yet being pulled strongly by a high magnetic field. Outrushing gas flow being pinched off then entrains the valve and pulls it to its seat, where the magnetic attraction force must be high enough to minimize bounce. The force impulse carrying the valve closed will end as the gas flow is completely cut off, and though cylinder pressure will then build quickly to hold the valve, the valve may to bounce back open momentarily. The forces in this situation are strongly destabilizing, and a "perfect" no-impact landing may be unachievable with this kind of magnetic control. Further research and empirical testing will reveal the best control strategies for minimizing landing impact and bounce and for assuring that the valve does not fail to latch in these situations. The strategy of designing and selecting control strips in state space provides the basic tool to make this kind of optimization possible.

Returning from considerations of gas dynamic models and research into optimal strategies, the focus here is on the overall approach of developing and mastering the use of guiding control strips in state space, followed by development of higher order strategies in which in-flight course perturbations, relative to a chosen control strip, lead to selection of a new strip that anticipates future conditions. In working with gas dynamic simulations with rapidly changing valve flow and pressure waves, reverse-time simulations like those described in reference to FIGS. 3 through 6 are not feasible. In the reverse-time simulation, a single parameter was adjusted to bring about a zero flux on the right side of the graph—the step size of the one-way inductive voltage function. The initial energy condition of the right was an outcome of the amplitude choice for the two-way function.

In more complicated simulations involving nonlinear gas dynamics creating pressure waves, and in empirical tests to design optimum control strips for different gas flow conditions, time reversal cannot be used. The solenoid armature needs to be started with an energy level arising from release conditions, and flux on the pull-in side then needs to be ramped up from zero. At the landing position X=0, the landing error will be two-dimensional, in velocity and flux linkage. There are two variables to control this landing error, the one-way and two-way inductive voltage functions described above. These two functions provide the needed degrees of freedom to hit the middle of the two-dimensional landing target, except possibly in destabilizing gas dynamic situations where "perfect" landing is unattainable and a best compromise landing is sought.

In performing simulations in forward time and aiming for the two-dimensional landing target, it has been found that the two-variable solution function is nearly singular at landing (X=0) when the landing velocity is very low (Y approaching 0). A small perturbation in height of the armature as it nears a stop causes a large perturbation in the time that it takes to land. The alteration in landing time produces an alteration in the flux reached at landing, since flux is increasing rapidly through the landing. Thus, attempts to control the flux at the instant of landing become increasingly difficult as the system approaches a "perfect" zero-velocity landing, with diverging sensitivity of the landing time to small height perturbations. A practical mathematical approach is to solve not for conditions at the landing point X=0, but rather to solve for landing conditions at the instant when flux crosses its target value, the defined latching flux that just holds the valve in a closed position. Then the flux error is zero by definition, but the position X is not necessarily the landing position at zero. The solution procedure then varies the one-way and two-way inductive voltage functions, seeking simultaneous solution for X=0 and dX/dt=Y=Y0, a landing position and a small negative velocity at the moment when flux reaches its latching target, Z=Z0. The solution needs to be approached from the X>0 side, unless in simulation there is a continuous definition for hypothetical motion slightly beyond the landing surface. In real systems, X=0 represents an impenetrable boundary. The solution attained is the desired target, but the choice of variables leads to a better-behaved mathematical process for finding the solution. This process is applicable even in iterative empirical testing of real valves with gas flow, again seeking the best possible landing.

The control system thus far described causes all solenoid trajectories to converge toward a target strip in state space. The paths in the target strip converge to a desirable landing target, or in the case illustrated, toward a single path leading to the landing target. This single path was chosen to provide roughly maximum latitude for course correction, which was accomplished by constructing a second strip of converging trajectories taking over from the original strip where that first strip is converging and becoming excessively sloped, therefore generating too much feedback correction and amplifying system noise. The strip or strips that lead to convergence must represent achievable paths, consistent with the limitations of the actual system and controller. In particular, the system must be able to reach and track the strip within limitations of sensor resolution and noise and, in a sampled data system, with delay between the sampling of path data and the setting drive output values over finite intervals. The following paragraphs outline how to modify the strip definition to account for the delays of a sampled data system. Except at the constraining boundaries of the strip, there is flexibility to vary the target paths, with differing choices concerning the paths and how they converge together affecting system performance and sensitivity of noise, measurement error, and sampled data system delays.

It will be noted here that the feedback system being described is not designed to define an error and minimize that error as quickly as possible. A philosophy behind the design is that the primary objective is to bring the system to a landing with low impact and such that latching is maintained after landing. Like checkmate in chess, there is a single objective, achieved at the end of the process. Fast moving solenoids with powerful springs leave very little latitude for layering of secondary objectives, such as adjusting valve transit time in mid-flight. Small transit time corrections can be built up by elaborations on the methods taught, recognizing the explicit description of boundaries which, if exceeded, assure that low-impact landing with latching becomes impossible. The approach taught here benefits from its generality—as long as the characteristics of a controlled solenoid system can be described and traces generated repeatedly, whether in simulation or in instrumented tests, then control surfaces can be constructed to embody knowledge of how to achieve control. The following paragraph will extend this description of embodied knowledge to deal with the time delays of a sampled data system.

The state space portrayed above describes a continuously varying target flux linkage as a function of a position and a velocity. By developing a computer simulation model that closely approximates the performance of a real solenoid, and by storing data describing various state space trajectories, it is possible to look forward and backward in time, relative to any given trajectory point, in order to determine how "past" data can best be employed to control a "future" outcome. The same predictive capability is obtained from a database of instrumented trajectories in real systems. Consider a sampled data system that controls an output voltage over finite intervals by setting a PWM, that is, a duty cycle from a Pulse Width Modulation driver. A product of PWM and supply voltages defines an average applied voltage over a time interval. With that information and a measured current for resistive voltage correction, the average inductive voltage is determined. The true average is not known to maximum accuracy until the end of the interval, however, when current is re-measured. Average current over the interval is well approximated by the average of the currents measured at the start and at the end of the interval. Consider some reference time, t0, marking the end of a PWM setting and the sampling time for electric current. Using PWM, supply voltage, and current at the start and end of the interval leading up to t0, average applied voltage is computed and corrected for resistive voltage drop, leading to an average value for inductive voltage. This average is multiplied by the time step, call it "dt", and the product, in volt-seconds, is summed with an earlier flux linkage to provide a flux linkage updated to the time t0. The ratio of the current to the updated flux linkage establishes the position of the solenoid. A measure of average velocity is determined using this and one or more previous computed positions, for example, a simple difference between the most recent and next-most-recent computed positions. The position and average velocity measures, as actually determined from discrete samples, define the state space coordinates X and Y. While these computations are taking place, an on-going PWM has already been set, based on the best available previous data. When the system reaches the next time marker, t1, it will set a new PWM to extend from t1 to t2, based on sampled data available up to t0. The following paragraph describes one among many procedures to set this new PWM value.

Precomputed target trajectory data may be represented as a collection of feasible, successful target paths, for example, the nine paths numbered 0 through 8, as illustrated in FIGS. 7, 8, and 9. A continuum of paths interspaced between these nine forms a continuous target strip, any path along which will lead to a successful valve opening or closure with solenoid latching. Using the ordinates of position (X) and position difference (Y), an interpolating function then selects a path number, P#, generally not an integer, on a continuous interval, for example, from 0 to 8 for interpolation between the paths of the example. The coordinate pair (X,P#) is then used to look up two other parameters. The first parameter is the flux linkage, nΦ, associated with the path line P# and with the time that is two time steps into the future, relative to arrival at X. Thus, for data associated with start time t0, the flux linkage target will be that for time t2. The second parameter is the current, I, extrapolated two time steps ahead, being the expected current at time t2 if, indeed, the controller can keep the system tracking the interpolated path associated with P#.

The controller program is designed to get the solenoid system to the designated flux linkage at t2, which should also keep the system on the same path associated with P#. Current is known at t0 and projected to t2. From these two values, an average current is computed, from which an average dissipative voltage drop IR is computed. Multiplication of the negative number −IR by 2·dt yields a negative voltage impulse, which is part of the total change in flux linkage from t0 to t2. The PWM duty cycle that has already been set for the interval from t0 to t1, multiplied by the power supply voltage and by dt, yields a second contribution to the change in flux linkage. The target change in flux linkage is the difference between the value of no at to and the target value at t2. With these numbers, it is possible to solve for the average applied voltage and the corresponding PWM setting required, over the interval from t1 to t2, in order to reach the target flux. FIG. 13 is a flow diagram providing more detail of the steps just described. FIG. 14 incorporates the steps of FIG. 13 into the larger context of coordinated release and capture of a solenoid opening a cylinder valve, where that opening process is affected by cylinder pressure. The details of FIGS. 13 and 14 are described in the next section, for a preferred embodiment of the invention.

Figure 10:
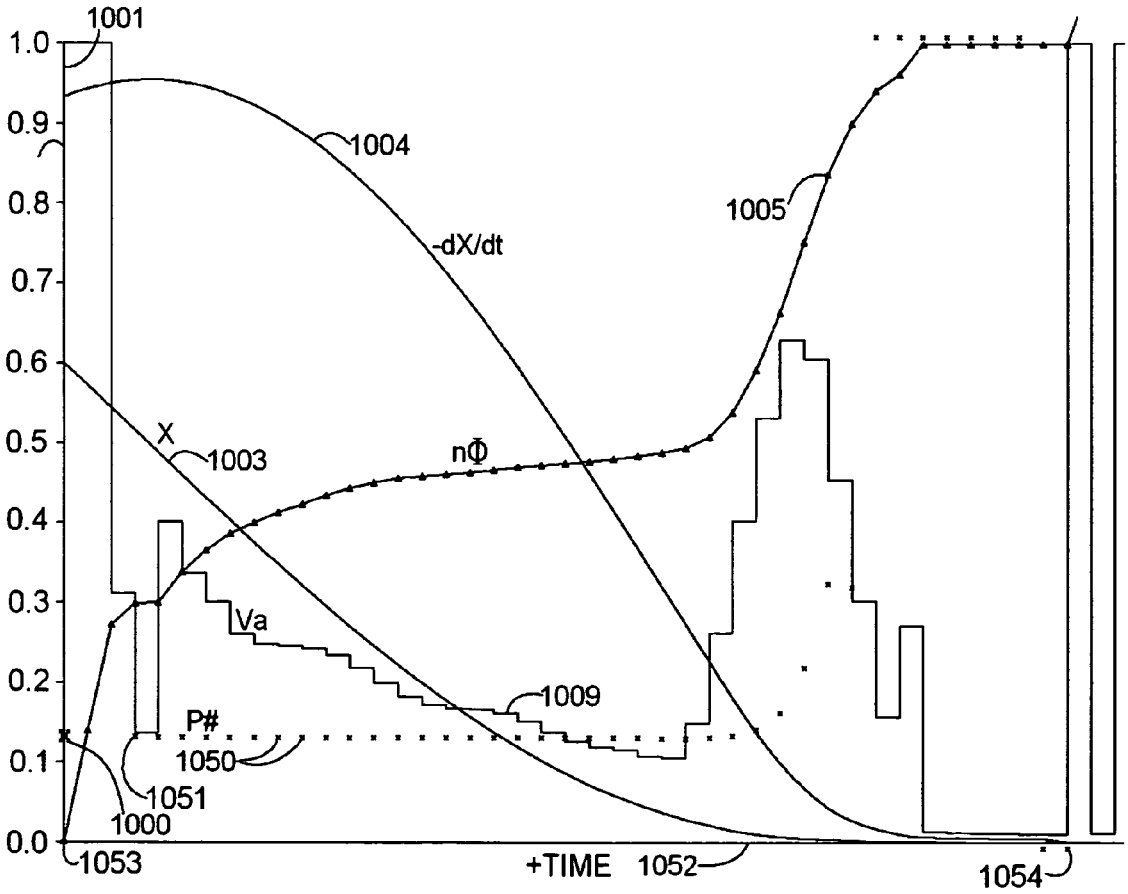
FIG. 10 illustrates simulated controlled operation of a solenoid using information like that embodied in the control surfaces of FIGS. 9 and 10, specifically for a high initial kinetic energy of the armature, similar to FIG. 6.
Figure 11:
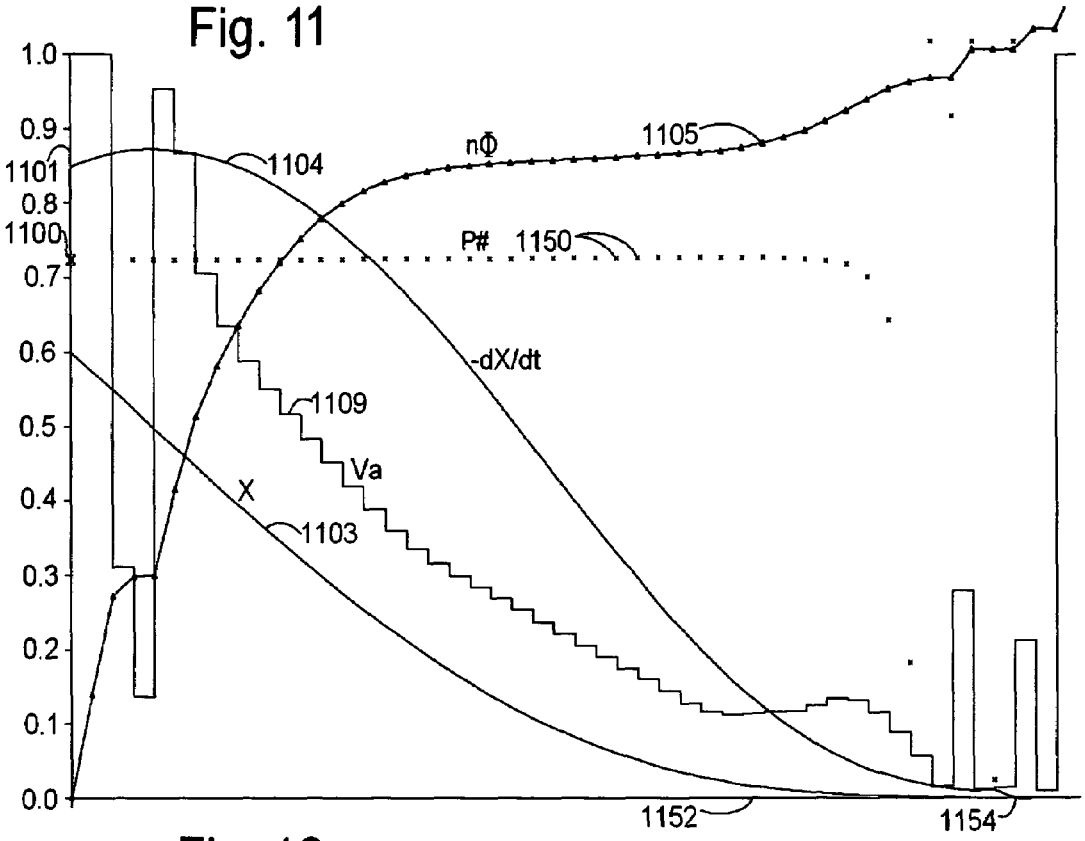
FIG. 11 is similar to FIG. 10, but for a low initial mechanical energy of the armature, similar to FIG. 5.

The outcome of the control process just described is illustrated in FIGS. 10 and 11, respectively illustrating control for initial conditions of high and low mechanical energy. Starting with the high initial energy situation of FIG. 10, position trace 1003, "X," enters the graph region at 0.6 on vertical axis 1001, running in normalized units from 0 to 1, while positive time is traced along axis 1052. At this entry point, a path number value has been estimated based on data from the just-completed armature release from the opposite yoke. The path number "P#," here normalized to range from 0 to 1, is indicated by the "X" symbol at 1000, on the lower left of the graph. This estimate can be used for early actuation, until good data are available from the pulling-in solenoid for updating the "P#" parameter. Stairsteps in trace 1009 of applied voltage Va indicate that this voltage is fixed by computation for discrete intervals. A more detailed, and confusing, graph might show one or more duty cycle oscillations in each interval, but a horizontal line segment representing the duty-cycle average is used here. The applied voltage starts at 1.0, the normalized upper voltage limit, where it remains for two computation cycles while the flux linkage trace 1005, "nΦ," slews upward from an initial value of zero at 1053 toward a normalized target plateau value of 0.3—that is, 30% of the minimum latching flux. The third voltage step is much lower, bringing the flux linkage up to its 30% target, where it holds constant for one time step. The discretely computed path numbers 1050, "P#," start at 1051, the first point where two consecutive positions have been computed from the ratio of current divided by flux-linkage, with sufficient resolution to compute a reliable velocity. Note that while P# is determinable from data at 1051, it is not actually computed until a fraction of a time step later. From P# at 1051, the controller computes a flux target for two time steps past 1051, following the procedure already described above. Based on this target and the on-going applied voltage immediately following 1051 (at about 0.13 normalized units in this illustration), the controller sets a new voltage (at about 0.4), which takes effect at the end of the computation and output-setting interval. Trace 1005 follows approximately straight line segments between graph markers, due to the constancy of the applied voltage, though continuous variation in resistive voltage drop would cause some curvature. This description ignores the sawtooth ripple that would arise from a PWM drive. Similar computations continue, with negative velocity trace 1004, "−dX/dt," passing its peak and falling smoothly toward zero as position trace 1003, "X," also moves toward zero. The value of P# remains virtually constant while flux linkage trace 1005 climbs slowly, current declines (current not graphed), and applied voltage 1009 declines. A region is reached, corresponding roughly to the inductive voltage transition from 613 to 609 in FIG. 6, where the applied voltage rises quickly, causing a more rapid rise in flux linkage. (The program for generating FIGS. 10 and 11 allows for steeper changes in flux linkage, with large transitions being completed earlier or being initiated later than curves from earlier figures.) As the armature slows and approaches closure, the path control surfaces (such as those shown in state spaces 800 and 900) become much steeper, and small errors result in substantial changes in the computed P#. Further progress down the path raises the error gain and begins to destabilize the feedback system, causing P# to jump around, going high for a period of time, then low—the small "x" marks at positive and negative full scale on the graph actually indicate off-scale values for computed P#. In this run, the flux linkage trace 1005 levels off near the latching threshold—the controller prevents reversal of direction of 1005 to avoid hysteresis problems. The armature almost stops before landing at 1054. At this landing point, coincidentally, the drive voltage goes full positive, raising the flux linkage off the graph scale. The controller does not actually recognize the landing until two steps after 1054, when a final positive voltage pulse brings the flux linkage intentionally quite high, well above the latching threshold (and off the graph scale), as a measure to ensure no bounce or unintended release. The controller may subsequently lower the flux linkage to conserve energy, getting on the side of the magnetic hysteresis curve where the magnetic memory of the system favors latching and reduces the required holding current.

While the traces of FIG. 10 resemble those of FIG. 6, the traces of FIG. 11 resemble the traces of FIG. 5, adapting to a low initial armature energy. The number labels "11xx" for FIG. 11 correspond to the labels "10xx" for FIG. 10, with differences related to the low initial energy of FIG. 11. Applied voltage 1109 goes high at the beginning of the feedback-control region, bringing the flux linkage up very rapidly, more rapidly than in the similar time-reversed case of FIG. 5. As in FIG. 10, the P# values become unstable shortly before landing at 1154. A variation on the controller program holds P# constant going into this sensitive landing region, causing flux linkage to vary as a function of position alone, ignoring velocity.

Control Steps for a Preferred Embodiment

In the context provided by the preceding text and figures, a preferred embodiment of the system consists of a dual-latching solenoid comparable to that pictured in FIG. 1, with a controller interface to a microprocessor having the major features of FIG. 2. Preliminary to the steps to be described, it is assumed that the dynamic characteristics of the solenoid have been characterized, for example, by time-reversed computer simulations like those illustrated in FIGS. 3, 4, 5, and 6, or by forward time simulations, or by empirical testing, and that the results of such simulations have been reduced to a numerical description of one or more control surfaces like that illustrated in FIG. 7 (for a domain of feasible trajectories) and FIGS. 8 and 9 (for control surfaces raised above the 2-dimensional domain). It is also assumed that further comparable control surfaces have been developed for convergence of the system on a closer approach to landing, and that a composite control surface has been described, where the control shifts from one surface description to another in the course of a trajectory.

A further logical extension of the above descriptions is to a control surface for armature release, as opposed to armature capture. In the context of release, particularly for the opening of a valve with a pressure differential across the valve, that pressure differential will generally drop as the valve opens, but not before the pressure differential has added or removed mechanical energy from the motion of the armature and valve. The valve-armature system will generally lose energy when opening an exhaust valve against positive cylinder pressure, while a comparable system with an intake valve may gain energy, depending on valve opening time relative to crank angle, also depending on the amount and temperature of exhaust gas remaining in the cylinder, and finally depending on intake manifold pressure, which may be elevated by intake turbocharging or supercharging. The goal of the controller for armature release is to bring the total energy of the valve-armature system, that is, the sum of kinetic plus spring-potential energy, as near as possible to a standardized energy level, leading to entry on a middle trajectory of the ribbon of pull-in trajectories.

The expected energy gain or loss is computed approximately or estimated, in advance, based on expected manifold pressure, cylinder charge and temperature, and cylinder volume at a time projected shortly after the valve opening time. The cylinder volume estimate can be an empirical expression depending on crank angle at the nominal release time and on the crank rotation rate. The effective decay time of pressure differential across the valve will depend (among other variables) on the volume and pressure in the cylinder, which will affect the speed of valve opening and the rate of decay of pressure as a function of valve position. Cylinder volume and pressure will be altered during this decay time by piston motion, which in turn will depend on crank angle and angular velocity. Valve energy loss can be expressed approximately as if for an effective static cylinder volume and pressure (relative to the manifold), where that effective static volume is extrapolated from the initial valve opening time by a delay based on an expected rate of pressure equilibration. This estimation process is an important component of deciding when to initiate valve opening. For predictable control of cylinder flow, one wants to control when the valve "effectively" opens. To do so, one must initiate valve release before that effective opening time, anticipating delay.

The details of this topic of valve opening delay and opening energy loss are beyond the scope of the current specification, except for the following information: valve energy gain or loss will be anticipated, crudely or relatively accurately, and this anticipation will select an entire control surface for the valve release process. The "target" for trajectory convergence on release is not fixed, like a landing target, but depends on a variable prediction of gas flow perturbations extending well into the duration of the release trajectory. If cumulative gas force losses are expected to be high, the target trajectory should specify a rapid reduction in flux linkage, so that the magnetic force pulling back on the releasing armature will decline quickly and will take away a minimum amount of energy. If cumulative gas force losses are expected to be low or negative, the target trajectory should specify a rapid increase in flux linkage starting soon after armature release, not enough to pull the armature back to latching on the same side, but enough to reduce the mechanical energy by a relatively large amount.

Figure 12:
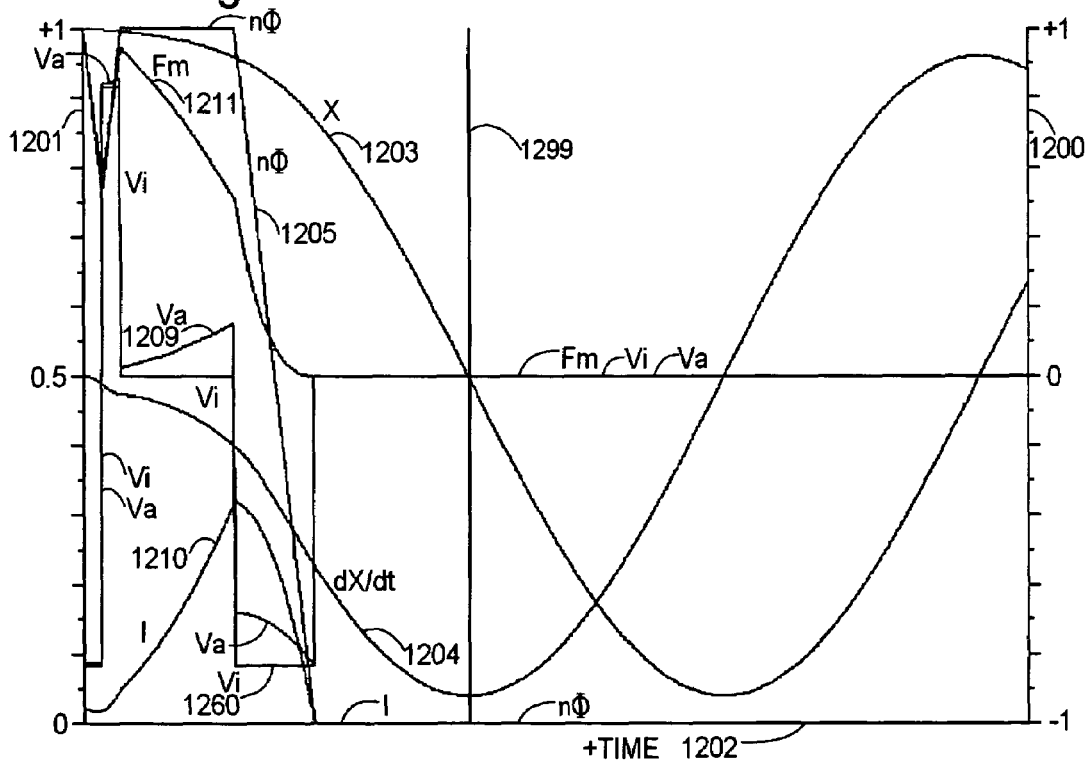
FIG. 12 illustrates the controlled release of a solenoid armature from latching, dropping the magnetic field rapidly for positive release with minimum time uncertainty, but then bringing the field strength back up to pull excess mechanical energy out of the armature.

Unlike a pull-in trajectory based on monotonic change in flux linkage, a release trajectory may require reversals in the directional change of flux linkage, for example, a rapid reduction for quick clean release, followed by rapid increase to pull out excess mechanical energy, followed by a final flux reduction to zero. This strategy of energy removal is illustrated in FIG. 12, which traces a simulated armature release with respect to the forward time axis 1202. The scale of vertical axis 1201 on the left is normalized to the range from 0.0 to 1.0 while a secondary vertical axis 1200 on the right is normalized to the bipolar range from −1.0 to +1.0. The traces, categorized as monopolar or bipolar in relation to axis 1201 or 1200, are 1203 as bipolar position "X" (with the usual zero-gap X-value being offset to +1.0 for the releasing side and −1.0 for the capturing side); 1204 as bipolar velocity "dx/dt;" 1205 as monopolar flux linkage "nΦ;" 1209 as bipolar applied voltage "Va;" 1210 as monopolar current "I;" 1211 as bipolar magnetic force "Fm;" and 1260 as bipolar inductive voltage "Vi." Entering the chart area at the top left corner, flux linkage declines rapidly past the holding threshold at +1, and velocity begins to go negative, as evident on the far-left side of velocity trace 1204. Once the release is under way, the flux linkage is quickly returned to the latching threshold. The traces 1211 for magnetic force and 1205 for flux linkage each make a "V" shape, almost superimposed, although the fractional reduction in the bipolar trace 1211 is roughly twice as great as for the monopolar trace 1205. Note that the traces are on different scales, while magnetic force is declining initially in proportion to the square of flux linkage. By the time the flux linkage has risen back to 1.0, the magnetic force is less than 100% because of the increasing armature-yoke gap. 1211 continues to fall with increasing magnetic gap (relative to a gap-closed X at 1.0), but with enough attraction force remaining to extract a significant amount of mechanical energy from the armature. The inductive voltage trace 1260 is held at zero while current trace 1210 rises rapidly with increasing magnetic gap, causing a resistive voltage to raise the applied voltage trace 1209 increasingly above the flat inductive voltage. An abrupt application of negative inductive voltage pulls the flux linkage rapidly to zero, removing the magnetic attraction and ending the transfer of energy out of the armature. For normal capture, new electrical traces would be needed to track the operation of the capturing side of the solenoid, while path-number feedback control would be initiated, for example, in the vicinity of vertical line 1299, marking the midpoint of armature travel. As simulated here with no activity on the pull-in side, the armature traces a harmonic oscillation, with position and velocity reaching equal fractions of their full-scale ranges.

Like landing control, release control by a "sensorless" or "down wire" approach gives the best position information when the change in flux linkage is monotonic. When flux linkage is changing in one direction and without excessive fluctuation in the inductive voltage, the magnetic system follows one side of its hysteresis curve, and eddy currents are modeled reasonably well by a "shorted turn" approximation. In computing position from the ratio I/nΦ, the apparent position offset due to hysteresis causes the magnetic gap to appear larger when nΦ is increasing, and smaller when nΦ is decreasing. Keeping this in mind, a technique for determining time-of-release and tracking velocity soon after release is as follows. Before the armature being drawn toward landing against a given yoke, nΦ is initialized to zero for that unenergized yoke. As voltage is applied to the yoke winding, the inductive voltage is integrated to track nΦ. When landing is achieved, nΦ is raised above a minimum overhead for holding, then lowered back down to the desired overhead, putting the system on the low-current side of the hysteresis loop. By taking advantage of the magnetic memory of the material, holding current is minimized. To prevent continuing flux linkage integration drift, voltage is held constant, current normally remains the same, and the flux linkage integration process is shut down, leaving the last value for flux linkage stored. If the armature should start to release unexpectedly while voltage is being maintained constant during latching, the current will immediately start to rise, and the controller can respond immediately by pulling the armature back before it is out of range. When latching is maintained at constant voltage and current and release is subsequently desired, then the flux linkage integration process is resumed while the solenoid is unlatched. The I/nΦ ratio during latching represents that constant held position, including hysteresis offset. This holding ratio should remain unchanged as flux is initially ramped down, until the armature begins to release. Upon release, the I/nΦ ratio will start to increase, tracking position change for as long as the inductive voltage is reasonably steady (disregarding high-frequency PWM content) and flux linkage is consequently monotonic. As soon as the flux linkage is brought back up (if at all) to pull energy out of the armature, as shown in FIG. 12, then highly-resolved position information may be lost in the "confusion" of hysteresis and eddy currents. By this time, however, the state of the gas-dynamic system affecting a cylinder valve can be characterized. The flux linkage at release indicates magnetic force and, by inference, gas pressure force. The pattern of acceleration immediately following release will predict gas-dynamic energy losses, which will vary in relation to cylinder volume and piston speed. An effective way to quantify such a pattern is through path number drift, which indicates cumulative deviation from a reference-"normal."

In the "down-wire" system for sensing position as described previously by Bergstrom (op. cit.) and employed in the preferred embodiment being described here, non-monotonic flux change and resulting hysteresis and eddy current effects will throw uncertainty into the computation of position from current and flux linkage. This uncertainty can affect the release process described immediately above, and it can affect the pull-in and capture process discussed throughout this Specification. The uncertainty in velocity as computed from position changes may be particularly significant following a direction reversal from rapidly declining to rapidly increasing flux linkage. Trajectory control, however, need only be approximate and can depend on a more nearly open-loop control process. The solution described here is to use an anticipatory estimate of gas energy exchange to specify a flux target as a function of position only. Lacking a velocity variable, the controller cannot determine a path number, P#, from position alone. The anticipated gas energy exchange figure will dictate a single trajectory path, associated with a fixed path number. The path number choice in this case defines the flux target as a function of position only. The "ribbon" of trajectory paths then describes an array of path choices, from which exactly one path is chosen in advance, based on anticipated conditions. This anticipation can combine a model of engine performance with a history of previous trajectory errors.

We move now to FIG. 13, which describes the process for following a pair of trajectory ribbon functions: a flux target function, and an anticipated electric current function. In chart 1300, titled "TRACK Sequence Chart," step 1302 specifies that the steps begin with initial values. Where an initial value is followed by a "prime" or single quote, as in "P#'", the "prime" indicates that the value corresponds to the next-most-recent time marker, or the time interval between the next-most-recent and the "current" time marker. An unprimed variable is for the current time marker or the interval following that marker. A subscript "plus" after a variable, as in "$PWM_+$", specifies the next time marker or the interval following that marker, while a subscript "double-plus," as in "$I_{++}$", specifies the time marker two steps ahead.

The initial condition in 1302 is a previous path number P#', a previous flux linkage nΦ', a previous pulse width modulation duty cycle PWM', a supply voltage B+ which is taken as effectively constant over the time intervals in question, a previous current I', and a present duty cycle PWM. Step 1304, "Start 1", is a return point for a program loop, to be entered either from the initial condition or after completion of a loop from below at 1342. Step 1306 calls for reading the Analog/Digital converter channel to obtain a present digitized value for current "I". A PWM duty cycle will be available, either as PWM from the initial condition, or as $PWM_+$ from below, where the subscript "+" goes away as the step number advances upon return to the "Start 1" entry point at 1304. This PWM duty cycle is applied to the output PWM controller in step 1308, thus controlling the average voltage to be applied over the current on-going interval. When a variable appears with arguments in parentheses, like a function with arguments, the notation means that the specified variable is computed from the arguments in parentheses and stored under the variable name. Thus in step 1310, Va'(B+, PWM') means that the applied voltage variable from the previous interval (note the "prime") is computed and stored based on the supply voltage B+ and on the PWM' for the previous interval (again noting the "prime".) In step 1312, the average resistive voltage Vr' is computed for the previous interval, based on a voltage loss computation from the current I measured at the end of the interval, the current I' measured at the beginning of the interval, the PWM' value measured over the interval, and the resistance function R.

In a typical PWM driver "totem-pole circuit" using field effect transistors or FETs, the on-resistance of FETs in the upper and lower portions of the totem-pole may differ. The effective resistance R will then depend on the PWM duty cycle, which determines the fraction of time for which different on-resistances apply. Thus, starting from a nominal average applied voltage Va', the resistive voltage correction is based on an average current deriving from the starting and end currents I' and I, and on a resistance function R that varies with the duty cycle being applied during the interval, PWM'. Note that in the presence of a nonlinear voltage drop, as with a diode, the resistance function R will be a nonlinear function of current rather than a simple multiplicative coefficient of current.

Continuing with step 1314, the average inductive voltage for the previous interval, Vi', is set to the average applied voltage Va' minus the average loss or resistive voltage Vr'. In step 1316, the flux linkage product nΦ is updated from the previous valve nΦ' by adding the product of the average inductive voltage over the previous interval, Vi', multiplied by the time step size dt. In step 1318, given current and flux linkage, position X is computed as a function of the ratio of current to flux linkage, I divided by nΦ. In step 1320, if the system is "going," that is, if there is a previous computed position X' available for use, then a velocity measure is computed as the position difference dX going from the previous X' to the current X. In step 1322, again if the system is "going," then the present estimate of path number, P#, is computed as a function of position X and the velocity indicator dX. This computation goes back to a family of curves like that illustrated in FIG. 7, except that the family is adjusted so that the "Y" axis corresponds to a finite change in position over one time step leading up to the present, rather than to an instantaneous velocity. If the system is not "going" in step 1322 but is in an initial iteration of the steps being specified, so that there is no available parameter dX, then the initial condition P#' is used for the path number. In the case of an armature release and in a situation where velocity indicators dX are not used (as described earlier), then a fixed choice of P# will prevail at step 1322, that choice being dictated for a release that will correct for anticipated exchanges of energy due to gas flow and pressure differential around the valve.

Step 1324 summarizes a decision process described earlier. During a trajectory with re-evaluations of P#, data may be collected on the total change in P# after the system has had time to correct its trajectory for vertical error with respect to the target strip. A position will be reached, called the "new strip" position, when the cumulative P# drift is evaluated and used to determine a new strip value. As indicated in step 1324, the action at that "new strip" position is to load a new target strip. Step 1324 is, of course, an optional correction, applicable in systems where there is course correction for variable external forces, unpredicted before a trajectory but predictable in the short term based on trend data.

In steps 1326 and 1328, the predictive power of the control method is exploited to advantage. Given that the solenoid system is following an identified trajectory path associated with the variable P#, that trajectory will be maintained if flux linkage progresses over two time steps from the recently computed value nΦ to the function value $n\Phi_{++}$ of step 1326, the function being computed from P# and present position X. Furthermore, electric current at that future time marker, being a function of anticipated position and flux linkage, is expected to match the function $I_{++}$ computed for P# and X in step 1328. In step 1330, to get to the desired flux linkage and current target, resistive voltage Vr is first computed for the present on-going time interval as a function of current I and a resistance function R that may depend on the PWM setting, as explained above. In step 1332, the inductive voltage Vi for the present interval is estimated starting with the supply voltage $B_+$ and the PWM, yielding an applied voltage, and then subtracting the resistive voltage Vr. Note that this estimate of inductive voltage will be refined if step 1312 is repeated, in which case the resistive voltage correction will make use of currents measured both at the beginning and the end of the time interval. This refinement is important for maintaining an accurate running total of changes in flux linkage. Step 1334 specifies the average inductive voltage value $Vi_+$ that needs to prevail over the coming time step in order to drive the flux linkage from the value nΦ to the future value $n\Phi_{++}$ over two time steps. The flux linkage difference, ($n\Phi_{++}$−−nΦ) is divided by the time increment dt to yield the sum of inductive voltages ($Vi+Vi_+$) over the present and the next consecutive time step. Subtracting out the inductive voltage computed for the present time step, Vi, yields the needed value $Vi_+$. In step 1336, the required next-interval value $PWM_+$ to get the desired inductive voltage is computed first by estimating an applied voltage $Va_+$ as the sum of $Vi_+$ and a resistive voltage IR, then obtaining the duty cycle value $PWM_+$ based on the supply voltage B+. An accurate computation of the resistive voltage IR may depend on a knowledge of $PWM_+$, which is not available going into step 1334. An estimate of IR may be based on the most recent value of R computed for a previous PWM. Going with the result of such an estimate in step 1338, a refined estimate of the coming resistive voltage $Vr_+$ is based on the extrapolated current $I_{++}$, on the nearly correct value $PWM_+$ from step 1336, and from the resistance function R, which may depend on $PWM_+$.

Completing the corrective iteration in step 1340, a refined value for $PWM_+$ is based on the sum of the future inductive voltage $Vi_+$ and the resistive voltage $Vr_+$, and on the supply voltage B+. Step 1342 ascertains if the trajectory is complete or still tracking. If complete, the procedure is done and control reverts to some other process at the "end" instruction. If still tracking, control reverts to "Start 1" at step 1304, following which the current I will be read before the system is disturbed by a new PWM setting, following which the refined value for $PWM_+$ from step 1340 is applied to the drive output, continuing the trajectory.

FIG. 14 outlines steps, among various alternatives, that can be used for initializing an armature release sequence followed by a capture sequence on the opposite side. The number 1400 identifies the entire chart, which is labeled "RELEASE & CAPTURE." In the larger context of FIG. 14, an engine system is assumed to include a crank angle sensor, yielding crank angle CA and information to determine the crank angular velocity. Cylinder pressure will be estimated based on the computed balance of magnetic force and spring force that falls below gas pressure force at the moment of valve opening. A crank angle valve release target $CA_0$ is set in advance, and in repeated step 1402, the system checks repeatedly for CA to pass the target. When the inequality condition indicates that the target $CA_0$ has been exceeded, control proceeds to step 1404, where the applied voltage Va is set to a negative release voltage $-V_{REL}$. The flux linkage nΦ then ramps down from an initial value that was set during armature capture for holding the armature latched, with the integral change in nΦ being tracked in step 1406. In step 1408, position x is defined as a function f of the ratio of current I to flux linkage nΦ. The lowercase position x is measured relative to the releasing yoke and is distinguished from the uppercase position X measured relative to the capturing yoke, which will take over control of the armature after release and energy-correcting control. In step 1410, position x is compared to a threshold $x_0$ defining release. Steps 1406, 1408, and 1410 are repeated until release is indicated. After release is identified, the release flux $n\Phi_{r1}$ is recorded in step 1412, along with related information about crank angle in step 1414, and the release time $t_1$ in step 1416, and possibly crank angular velocity in addition. In step 1418, an energy-compensating release path number, $P\#_r$, is computed as a function of the releasing flux and crank angle. Note that the crank angle defines the cylinder volume, and the releasing flux defines the cylinder pressure, over and above manifold pressure. Thus, the quantity and pressure of compressed gas anticipated to come past the valve is reasonably well defined. Since the piston will continue to move while the gas pressure is being released past the valve, a velocity term relating to crank angle and angular velocity can give a better estimate of $P\#_r$. Note that $P\#_r$ will be taken as constant for the release tracking of FIG. 13, and a velocity indicator dX will not be used. With the definition of $P\#_r$, the system proceeds in step 1420 to a trajectory tracking routine like that of FIG. 13, in this case called Track_Release, which is adjusted as a function of the fixed path parameter $P\#_r$. The system loops through the procedure 1420 and the query 1422, which determines when position x has fallen below the threshold $x_2$ for takeover by the pull-in yoke. In step 1424, a new path number P# is defined for capture, based on the releasing path parameter $P\#_r$ and also on the time that elapsed from release time $t_1$ to the time $t_2$ when x first fell below $x_2$. Time interpolation between discrete sampling times may be used to refine the time markers $t_1$ and $t_2$, providing more accurate energy and path number indicators.

At this point, the release tracking program is reduced to a simple shutdown procedure, in which the PWM modulator is set (for example) to behave like a simple resistance, causing flux linkage in the releasing yoke to decay exponentially to zero. With the anticipated residual energy spread feeding into the capture and latching procedure, step 1426 initiates the "Track_Capture" sequence that is described in FIG. 13. For a predefined initial number of time steps, designated n_steps in step 1426, the tracking algorithm operates completely open-loop, ramping inductive voltage up to an initial plateau such as the plateau 408 in FIG. 4, the first level spot achieved after inductive voltage ramps up from zero going from right to left. The level of the plateau is fixed by the variable P#. During this period of time, the change of solenoid inductance with position is very low, so that the current/flux ratio indicator of position gives poor resolution. As resolution improves, position values become valid, while position differences continue to be weak indicators of velocity. In this region, following the n_step delay (where that number of steps may be as small as one step), a valid position is computed and may be used in either or both of two ways. First, the tracking procedure transitions from dictating an open-loop time sequence of inductive voltages to dictating flux targets as a function of P# and position. Second, optionally and at any point in the m_step sequence concluding step 1426, position X at a specified time point in the pull-in sequence can be compared to the position $x_2$ associated with time $t_2$ that defined the termination of the release sequence, taking account of the fixed geometric relationship between the release gap x and the pull-in gap X. That finite position difference can provide the first lookup function for a refined value of the trajectory parameter P#. Whether or not the parameter P# is thus refined, the conclusion of the second sequence "m_steps" designates the time where differences dX in position X of the pull-in control process result in updated computations of P#. At this point and moving to step 1428, control designated as "Track_Capture" reverts entirely to the "main sequence" of steps described with reference to FIG. 13.

Resolution of position and velocity improve as the magnetic gap closes and the sensitivity of the position measure improves. The system avoids violent changes in the solenoid driver output and follows a trajectory that has been pre-optimized for the particular energy conditions set up during armature release, which may have been influenced substantially by gas forces. Multiple indications of gas force influences have given rise to compensatory control adjustments during release, with the range for further adjustment maximized by the pull-in procedures, so that the system tolerates large perturbations, including gas flow perturbations that might not have been anticipated from prior operation cycles. The logic of the system focuses largely on a single event at the end of the control sequence: combined landing and latching.

Dynamic Simulation for State Space Trajectories

Though many researchers have developed state space simulations of solenoids, the approaches to the physical description and mathematical modeling have varied. To clarify the origins of the state space trajectories and surfaces illustrated and discussed earlier in this specification, a brief description of one of the simulations used to develop these surfaces is provided here.

Figure 15:
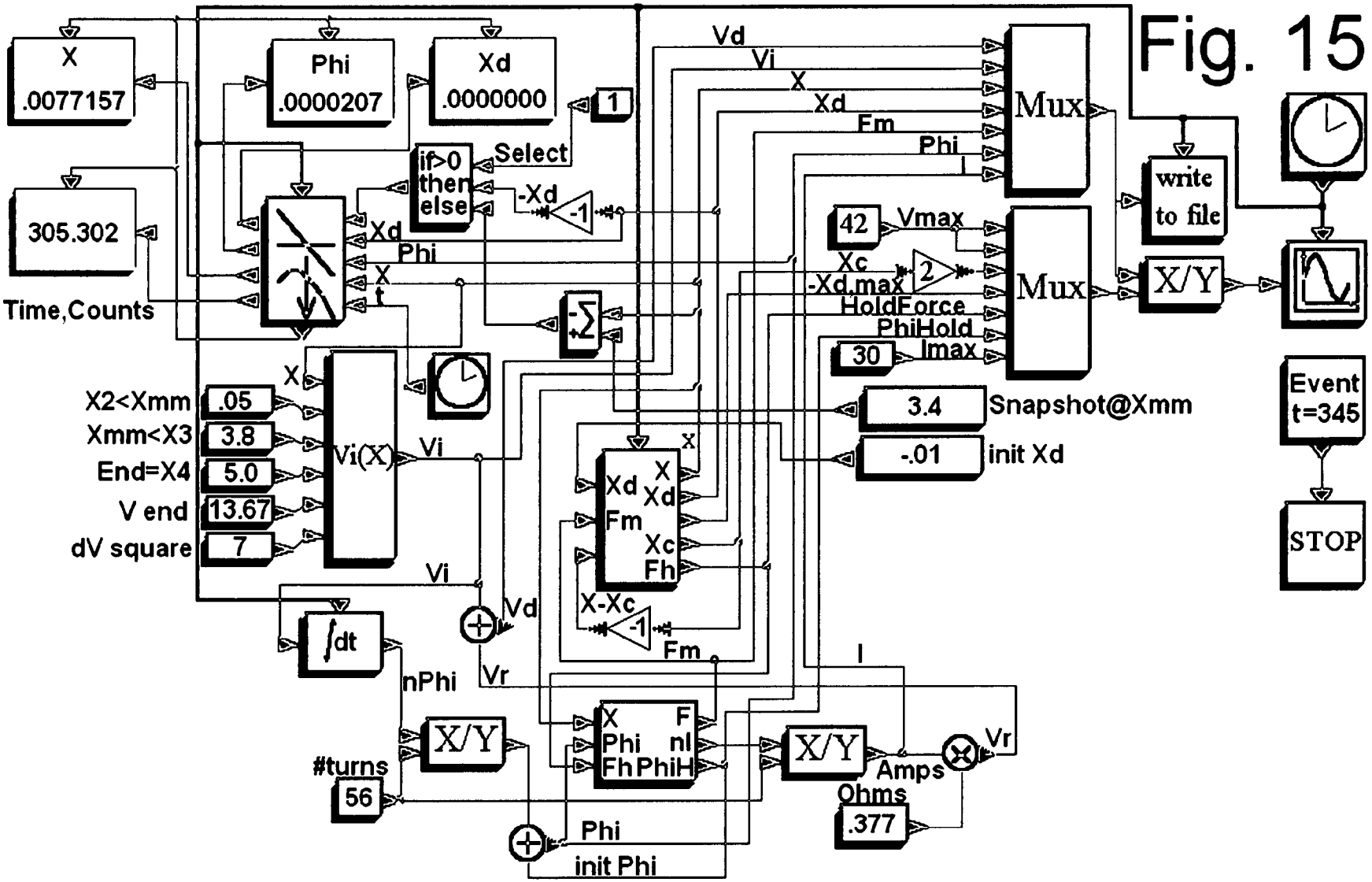
FIG. 15 is a program diagram of reverse-time dynamic simulation of a solenoid.

FIG. 15 is a computational flow diagram, actually taken from a simulation program written in Scicos, a system for diagramming and simulating dynamic systems, written in the Scilab programming language. Variables or arrays are passed from module to module via lines with arrowheads indicating direction. Some modules represent time integrations, which are synchronized by a clock, seen on the upper right and with synchronizing pulses connected to modules in these diagrams by double-thickness lines. The clock also synchronizes the operations of writing data to a file (to the left of the clock) and plotting from point to point on multitrace graphs (below the clock), as shown for example in FIGS. 3 through 6. The simulation process is initiated at a time zero and stopped at a pre-selected event time, or clock count, here indicated as "Event t=345", a module connected to a "STOP" module. Multiple variables are assembled into arrays by multiplexer modules, "Mux", two of which are shown. The upper multiplexer takes in variables to be graphed: "Vdrive" is the drive voltage arising from the PWM drive signal and not counting any resistive losses; "Vi" is the inductive voltage left after resistive losses are deducted from the drive voltage "Vd"; "X" is armature position, expressed as gap from the attracting and latching yoke and going to zero at mechanical closure; "Xd" is the time derivative of X; "Fm" is the magnetic force of attraction exerted on the armature; "Phi" is the average flux linking a drive winding, and is defined as the flux linkage "nPhi" divided by the winding count "n"; and "I" is the coil current. The inputs to the lower of the two multiplexers are normalizing scaling coefficients associated with the variables of the upper multiplexer: "Vmax", the supply voltage, here 42 volts, to scale both "Vd" and "Vi"; double "Xc" where "Xc" is the center position "X", which is the maximum spring deflection from neutral at the latching point; "−Xd,max" is the maximum positive magnitude of the negative velocity "Xd,max" that would be achieved if the armature were moved to the maximum deflection distance "Xc" and released instantaneously, allowing all the spring potential energy to be converted to kinetic energy; "Fh" is the spring force at latching, which is also the defined magnetic holding force; "PhiHold" is the flux that produces the holding force when the armature is in latching contact with a yoke; and "Imax" is a maximum current, here arbitrarily chosen as 30 amps and having no special physical significance.

The diagram displays four parameters, viewed on the left below the top, top left, and going to the right, as "Time, Counts", "X", "Phi", and "Xd". These values are sampled, with interpolation between clock counts, by the module shown below the "Phi" number display box. That module is triggered to sample when the continuous variable going in on the upper right crosses through zero from positive to negative. The variable triggering this module is selected as one of two choices, either the usually positive quantity "−Xd", the negative of the negative closing velocity of the armature, or by the difference "X mm−X", representing the difference between a preset millimeter distance Snapshot@X mm, here set to 3.4 millimeters, and the position variable "X". In this case, the number "1" going into a selection module above and to the right of the triggering sample/hold module causes triggering on the "−Xd" variable, causing the parameter display box labeled "Xd" to show zero, the value that triggered the sampling. In the simulation run just completed, the velocity "Xd" changed signs at 305.302 clock counts (interpolated), at which time X was 0.0077157 meters, Phi was 0.0000207 Webers, and of course Xd was zero, since the interpolated samples triggered on that zero threshold.

The simulation being diagrammed can be set up to run in forward or reverse time, simply by changing the sign of the time increment variable "dt" that appears in various time integration modules (see later), and by adjusting initial conditions to represent the beginning or the completion of a state space trajectory. The dissipative effect of electrical resistance is computed correctly in the model for both forward and reverse time. The simulation drives the system with a preprogrammed inductive voltage, "Vi(X)", coming from the program module shown center-left and fed by six inputs. The output is a function of X, the uppermost of the inputs coming into the left side of the module. The voltage output is initialized to 18 volts in the illustrated runs, where the 18 volt parameter setting is in the code of the diagrammed module rather than coming from one of the displayed inputs. This initial voltage is labeled "Vi1" on the left-most tier level of FIG. 3. The net drive voltage "V" is computed based on the inductive voltage "Vi" by an addition module, a circle with an arrow emerging to the right, shown below and to the right of the inductive voltage generator module and receiving as inputs inductive voltage "Vi" and resistive voltage "Vr", yielding as output the drive voltage "Vd".

The function of the code inside the "Vi(X)" module was described above, beginning with rounded step waveforms generated in the time domain using the hyperbolic tangent function, then transforming these waveforms to functions of position "X" based on a reference trajectory, X(t), X as a function of time. In the particular instance of the code module illustrated, mathematical functions were used to create a close-fitting curve fit to a numerically generated trajectory X(t), leading to a mathematical algorithm for generating Vi(X), rather than the alternative approach of using an interpolating table lookup with a numerically generated X(t) reference curve. Examining the inputs on the left of the "Vi(X)" module, below the top "X" input is a millimeter threshold "X2<X mm" set at 0.05 millimeters, marking the boundary where the inductive voltage begins to deviate from the final-closure value of 18 volts. The double stair step functions, called the "one-way inductive voltage function" and the "two-way inductive voltage function" have already been described and illustrated. The boundary of those two functions closer to landing is the "X2<X mm" input just described, while the boundary farther from landing is the next module input down, "X mm<X3", in this instance with the numeric value 3.8 millimeters. The next input down, "End=X4" with the numeric value 5 millimeters, sets the armature position for the center of the inductive voltage ramp-up from zero to the first of the tiers in forward time. Note that the previous two position markers represent the extreme ends of the transition ramps, rather than ramp mid-points.

The next two inputs to "Vi(X)" are the settings that are varied to create a family of trajectories. The lowermost variable, "dV square" and shown here at 7 volts, sets the zero-to-peak amplitude of the "two-way inductive voltage function". This parameter is varied in equal steps to generate the trajectories illustrated earlier and defining the target strip in state space. For each setting of "dV square" an adjustment is required on the next-to-bottom input variable, "V end", here shown at 13.67 volts and representing the tier level labeled "V13" in FIG. 3. The difference between this "V end" voltage and the "beginning" voltage of the reverse-time run, for example the 18 volt starting inductive voltage for the illustrated runs, sets that value of the "one-way inductive voltage function" described earlier. When "dV square" is fixed, then "V end" is varied to cause flux to level off at zero in the reverse time simulation. The displayed "Phi" value shown in FIG. 11, here 0.0000207, is the forward-time initial flux that should be driven to zero by varying "V end". This minimization of initial flux can be performed by hand using repeated simulation runs, or can be automated, for example, setting up a Newton-method iteration to adjust "V end" to drive the sampled "Phi" to zero. The resulting solution is the desired trajectory for the chosen value of "dV square".

The remainder of the FIG. 11 diagram is described briefly. Starting with the inductive voltage output "Vi" from the "Vi(X)" generator module, that inductive voltage drives a clocked module directly below the "Vi(X)" module, labeled with the symbol "∫dt". This module, actually a summation module, produces a cumulative sum "x+" of inputs "u" multiplied by a coefficient "B" which is here set to the small time increment "dt". A feedback coefficient "A" is set to zero for simple summation, representing time integration of an input function that changes stepwise. The output "y" is set to a cumulative sum "x+" by setting a coefficient "C" to one and a coefficient "D" to zero. The sum is incremented with each clock pulse, resulting in the flux linkage integral "nPhi", which is applied to a divide module "X/Y" for division by the number of winding turns, "#turns", in this case 56 turns. The scaled cumulative sum, which always starts at zero, is summed with an initial value "init Phi" to give the net value, Phi. The "init Phi" value is set to "PhiH" from a magnetic model module, with "PhiH" representing the holding flux that initializes the reverse-time simulation. Note that this initialization should be set to zero, not to "PhiH", for a forward-time simulation. The resulting flux Phi feeds a left center input to the magnetic model module diagrammed in FIG. 17, as described below. The other inputs to this module are gap position X and the holding force, Fh, a characteristic of the restoring spring and the maximum deflection, as determined in the "MDK" or "Mass, Damper, spring constant K" module viewed directly above the magnetic model module and above a gain triangle. Based on these inputs and internal parameter settings, the outputs from the magnetic model module are magnetic force "F", ampere-turns "nI", and the constant value "PhiH", the holding flux. As seen to the right of the magnetic model module, the ampere-turns output is divided by "#turns" to yield "Amps" and "Amps" is multiplied by "Ohms" to give the resistive voltage "Vr", which is summed with inductive voltage "Vi" to give the drive voltage "Vd" as discussed above. Connections are shown for different variables, for example, "Amps" as current "I", and other parameters that go to the multiplexers for output and display (the upper one), and for normalization scaling of the display graphs (the lower one). Concentrating on the modeled physics, the magnetic force "F" from the magnetic model module feeds in on the middle left of the "MDK" module as "Fm". The off-center spring deflection "X−Xc" feeds into "MDK" on the lower left, and the initial velocity "Xd", a constant, feeds into "MDK" on the upper left. For reverse time simulations, this initial velocity is set to a small negative or "closing" value, the landing velocity "init Xd" set by a constant parameter module, here with the output value —0.01. In the reverse time simulation, this parameter is the target impact velocity, a small number, which may be set to zero or to a small negative value where the control system may behave more consistently, especially when influenced by noise and measurement error, with a non-zero impact target. The outputs of the MDK module, from the top right going down, are position "X", velocity "Xd", the maximum scaling velocity constant "Xd,max" (label seen above and to the right on the wire from the module), the center position or deflection constant "Xc", and the holding force constant at that deflection, "Fh". Note that the MDK module is clocked and contains system parameters and integrators to obtain dynamically varying position and velocity outputs.

Figure 16:
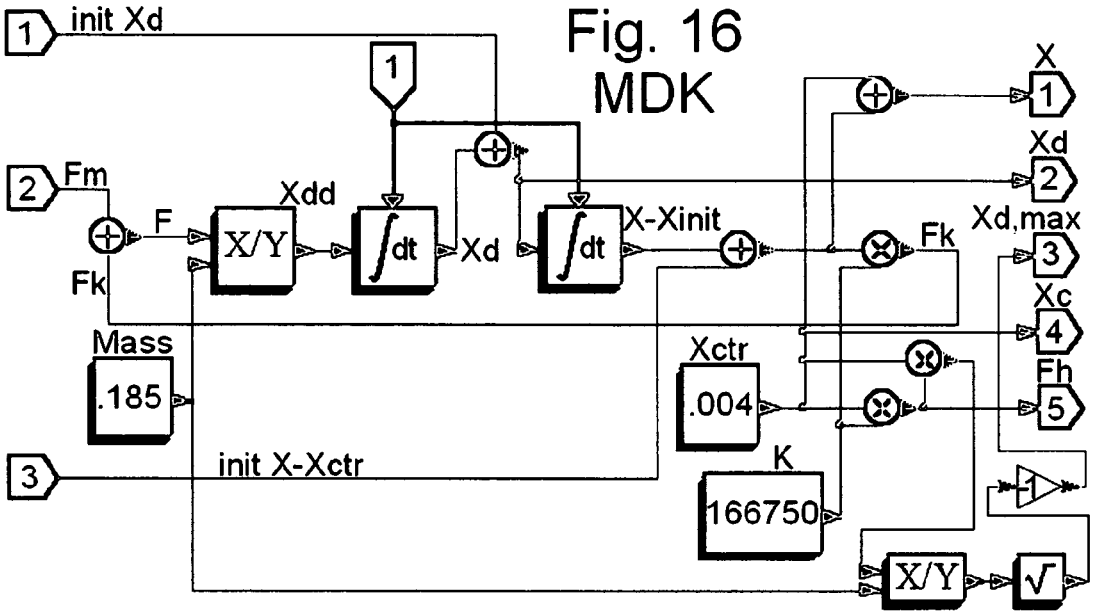
FIG. 16 is a component diagram from FIG. 15, showing the mass-spring-damper component of the simulation.

The mechanical dynamics or MDK module is described more thoroughly in reference to the diagram of FIG. 16. Module inputs are shown on the left as boxes with pointed ends, numbered 1, 2, and 3 in order of the top-to-bottom inputs of the diagram box. There is also a clock input box, pointed down and numbered 1. Magnetic force Fm comes in on input 2 and is summed with spring force Fk to give a net force F feeding into a division module. The denominator is "Mass" here set at 0.185 kilograms, the total effective moving mass including a fraction of the spring mass. The force/mass ratio is the second derivative of X, "Xdd", which feeds into a clocked integration module labeled "∫dt". This is a predictor integrator rather than a simple summing integrator (as was used for integrating the stepwise changing inductive voltage), yielding a more accurate integration of a continuous variable. The integrated velocity output, Xd, which starts from zero, is summed with input 1, "init Xd", to give the properly offset Xd output. This velocity also feeds into a second predictor integrator, whose output is "X−Xinit", the change in X from the start of the run. Input 3, "initial X−Xctr", is an initializing offset summed with "X−Xinit" to yield an off-center distance. This distance is multiplied by "K" to yield "Fk", which feeds back to sum with magnetic force, as already described. This same off-center distance is summed with the center offset "Xc" to yield the position output "X" relative to a zero at magnetic closure. The offset "Xc" is provided as a module output. Constant values for holding force "Fh" and for the velocity normalization constant "Xd,max" are also computed, based on the physical conversion of spring potential energy to kinetic energy.

Figure 17:
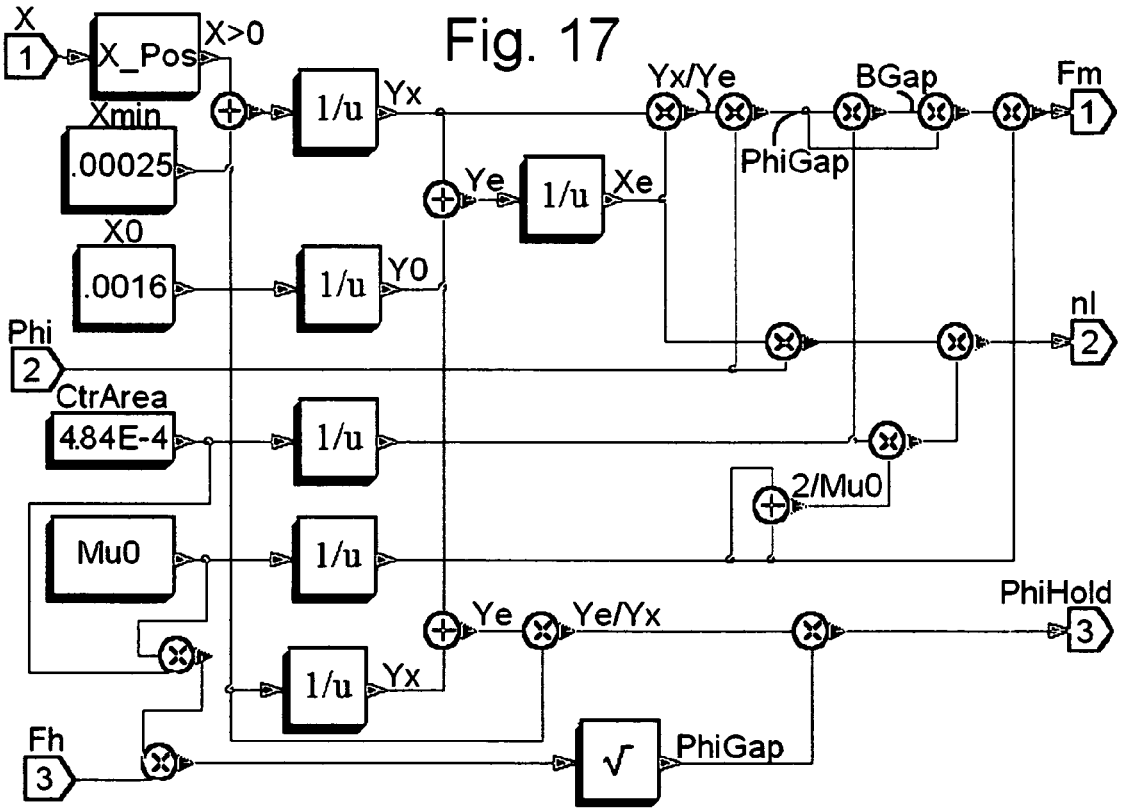
FIG. 17 is a component diagram from FIG. 15, showing the electromagnetic solenoid model as a component of the larger simulation.

FIG. 17 illustrates the electromagnetic model to determine outputs 1, 2, and 3, "Fm", "nI", and the constant "Phihold". Observe, importantly, that ampere-turns "nI" is a computed value, a dependent variable, in contrast to the analytic approach taken by Peterson, Stefanopoulou and others, making current a state variable. Computations in the controller being described, as well as in related simulations, are based on a drive voltage, adjusted by resistive voltage to give an inductive voltage, which linearly drives the rate of change of flux linkage. Once flux linkage is determined, and for a prescribed position X, current and force are fully determined and become dependent variables. While it is possible to implement the invention disclosed here using a model of current, inductance, and back-EMF, while targeting a desired current trajectory and adjusting the drive voltage appropriately to set the rate-of-change of current (after compensating for changing inductance and back-EMF), this approach is more complicated, and expected to require more computations, than the flux linkage approach. In addition, flux linkage is constrained by a saturation boundary, whose value varies predictably with position, so that it is important to focus attention on flux linkage. If saturation is avoided, then the current will not spike to excessive values.

Continuing with the magnetic model of FIG. 17, the inputs 1, 2, and 3 are gap position "X", coil flux "Phi", and the mechanically determined constant hold force, "Fh". Note that "Phi" is directly proportional to the flux linkage, which was determined by integration of inductive voltage, both in this simulation and in a control system as actually implemented in hardware and software. The gap position "X" is forced to be zero or positive by the module "X_Pos" with output "X>0", thus avoiding zero division. The non-negative X is summed with "X min", here 0.00025 meters, representing the effective minimum magnetic gap at mechanical closure of the solenoid gap. The reciprocal of this sum is a magnetic admittance, or reciprocal reluctance, called Yx. Associated with the stray magnetic paths of the solenoid is an equivalent leakage gap, "X0", here having the value 0.0016 meters, whose reciprocal "Y0" is a stray magnetic admittance, corresponding to a leakage inductance or reciprocal reluctance. The two admittances are summed to give "Ye" or equivalent magnetic admittance, whose reciprocal is "Xe" or "X effective". This parameter expresses the equivalent solenoid gap if there were no magnetic fringing or leakage effects, with magnetic flux traveling in straight parallel lines between the armature and yoke and entirely linking the windings. The designation "Xe" or "X effective" has been employed by Seale and Bergstrom, first in the application leading to U.S. Pat. No. 6,208,497, "System and method for servo control of nonlinear electromagnetic actuators." The computations described here represent a solenoid magnetic circuit as parallel resistors, representing reluctances, with a variable resistance in parallel with a fixed resistor. The variable resistance has a variable component proportional to gap X, plus a small fixed series resistance, corresponding to the minimum effective gap "X min", while the fixed resistance in parallel with this series pair of components, the flux leakage term, is defined by the distance "X0" associated with the same gap area as the variable gap term. This parallel resistance or parallel reluctance model provides a good empirical fit to many solenoids, particularly of the non-tubular type of primary interest in this patent. The "Xe" parameter is multiplied by the "Yx" admittance to yield the effective flux ratio "Yx/Ye". This ratio, multiplied by the flux linking the coil, "Phi", yields "PhiGap", a measure of flux effective crossing the gap between the armature and yoke to produce a magnetic force of attraction. This gap flux is divided by a center area "CtrArea" (here 4.84E−4 square meters) to yield a field strength "BGap" that can be compared meaningfully to a saturation B-field strength (for example, about 1.7 Teslas for typical silicon steel). The product of PhiGap and BGap, scaled by the reciprocal of the permeability-of-free-space constant "Mu0", yields the magnetic force "Fm" output, which in this case is the net force over two gaps, each having the area "CtrArea". The ampere-turns output is proportional to the product of coil flux "Phi_coil" multiplied by the effective gap parameter "Xe". The proportionality coefficients are the reciprocal of center area "CtrArea" and twice the reciprocal of "Mu0". The same theory that determines the "Mag_Force" output in the diagram is used to generate the bottom portion of the FIG. 13 diagram, which goes from the Hold_Force input number 3 to the Phi_hold output number 3.

With only the adjustment of the direction of time and of certain initial conditions, and with reversal of the direction of the inductive voltage function generator that drives the system, the simulation process described here can be set to run in forward or reverse time. If it runs in forward time, then parameters must be adjusted to give the desired landing, rather than the desired launch condition of zero initial flux linkage. Landing is described by a combination of three parameters, which in the FIG. 15 diagram are called X, Xd, and Phi, that is, position, velocity, and flux, here meaning flux linkage divided by the variable "#turns". The combination is that X=0, Xd=negative velocity near zero (or exactly zero), and Phi=latching Phi. The obvious solution approach is to use the sample and hold trigger module of FIG. 15 (or some similar detector) to trigger on X=0, sampling Xd and Phi at that trigger, then varying the function generator inputs called "V end" and "dV square" to cause Xd and Phi to hit the target values. As indicated earlier in this specification, this approach is difficult because of the near-zero slope of X at landing, causing the landing time at X=0 to vary widely for small changes in parameter values or small perturbations of the system. It works better to trigger detection on a latching value for Phi, and then to use the resulting values for X and Xd as the parameters to be driven to target values through variation of two inductive voltage function generator parameters, for example, "V end" and "dV square".

Looking at the landing problem more generally, what is desired at landing is a force balance, which happens to occur when X=0 and Phi is at the precomputed holding flux. In a more general case to be considered now, where the simulation incorporates a gas dynamic model, or where empirical data are used instead of a mathematical simulation, the holding flux may not be known. Gas forces acting on the just-closed valve will alter the force required to hold the valve, so the latching Phi will not be know in advance. Hence, a more general criterion for a landing solution is that when a force balance is reached, then position X should be zero and velocity Xd should be at the prescribed zero or near-zero negative value. Iterations with a gas dynamic model, or in a real instrumented test engine, will eventually yield a collection of trajectories to low-impact valve closure starting from various initial mechanical energies, though depending on the specific nature of the gas dynamic interaction, the sought-after solution may lie in a sensitive region and be difficult to attain. As was suggested earlier, if gas flow is tending to pull the valve closed, this is a destabilizing situation that can cause a "perfect" minimal-impact landing to be unattainable. In that case, trajectories are desired leading to the best attainable landings.

In the absence of variable gas dynamics, a complete set of landing trajectories from varying initial energy conditions can be described in terms of a single target strip of trajectories in three-dimensional state space. If there is a variable mass flow rate of gas at the time of valve closure, but with other conditions constant (such as speed of sound in the gas and geometry of the cylinder at the moment of valve closure), then one obtains a one-dimensional array of target strips, arrayed according to mass flow rate. If one such target strip is chosen for an expected mass flow rate, but the actual mass flow rate differs, then one expects a drift of the measured system trajectory across the trajectories of the target strip. An appropriate measure of the rate of drift is then correlated with the mass flow rate error, leading to a mid-course switch into a new data array, representing a trajectory strip for a nearly correct mass flow rate. The differences between data arrays for different mass flow rates may be approximated by simple empirical corrections to a single strip of trajectories in three dimensions, without resort to multiple 3-D arrays. Whatever the specifics of implementation, one obtains a very detailed feed-forward control model, demanding considerable computation before-the-fact, and some memory space, but little computation on-the-fly.

As suggested in the above paragraph, parameters other than mass flow rate may vary. Combinations of cavity sizes and sonic velocities will alter the way that a valve, interrupting a mass flow, will generate acoustic waves that reflect back to alter the flow and pressure across the valve. Neglecting interaction with other cylinders through a shared manifold, the manifold geometry will be constant but the cylinder geometry will vary with piston position. The effective cylinder size will depend on the actual cylinder size divided by the sonic speed of the gas—a high sonic speed makes the cylinder and manifold appear smaller. Cylinder geometry in the vicinity of valve closure time will be known in a controller system in which valve timing is adjusted as a function of crankshaft position. Thus, one can conceive of arrays of trajectories in the dimension of cylinder volume, or alternatively, empirical correction terms for crankshaft position. Going a step further, sonic speeds in fuel mixtures and exhaust gases will vary as functions of temperature (roughly as the square root of absolute temperature), while the gas compositions will be fairly constant. Thus, corrections may extend to the dimension of estimated temperature, which in a sophisticated engine control system will be approximately known from intake air temperature, fuel-air charge, etc. These suggestions for increasingly refined models go beyond research experience as of this writing, yet the approach to control that has been taught here accommodates layers of corrections as natural extensions of the process.

Comparing the described approach to more traditional state space approaches, the general approach in the past has been to describe a "plant" or nonlinear dynamic system analytically, and then invert the equations that describe the system, effectively linearizing the system. The approach taught here develops the same kind of linearized information, in part by choosing to control flux linkage, which responds to inductive voltage according to a linear first order differential equation. The nonlinear relationships relating magnetic force to flux linkage and position are inherent in the state space trajectory information, and are expressed in terms of the flux target, which varies according to position and velocity. Solution of the other relationships of the system is similarly implicit in the state space prescription for future target flux. The nonlinear effect involving current and dissipative voltage loss is considered in the second state space strip predicting future current, thereby permitting an accurate resistive voltage correction. The overall control system, as described, is more than a descriptive set of equations: the nonlinear effects are boiled down to a prescription for action, specifically for setting the step-by-step drive voltage or PWM that keeps the system on a desired track. The strip function evaluations can be by table lookup, with or without interpolation, or by various numeric function fit models. Unexpected operating conditions can be identified, quantified on-the-fly, and applied to alter the strip function definition, yielding highly sophisticated and predictive feed-forward control. Construction of a phase space target strip does not require mathematical inversion of the plant equations, but can be accomplished empirically, from simulation data or physical test data. It is recognized that especially when gas dynamics with wave propagation and reflection enter the picture, a full analytic description with inversion is difficult or impossible. The trajectory strip description is possible even in these complex circumstances, however, and can be derived first analytically in forward-time simulations, then refined using instrumented empirical tests to get at the complex "real" behavior of the system to be controlled. The methods described allow for interleaving or cross-fading among various trajectory strips developed for different portions of the convergent pathways, thereby permitting control of system gains. As was discussed, gain can be optimized for every region of a trajectory, trading off the effects of noise and error amplification against the effects of gain on convergence speed. Course corrections are applicable for both the release and landing portions of a trajectory, where release control both reduces the range of mechanical energy that must be accommodated in the pull-in and landing phase, and provides predictive information about gas flow conditions. Whereas others have used valve opening delay as an empirical indicator for valve timing, the current approach, with flux control and explicit knowledge of magnetic force, yields quantitative knowledge of gas pressure at the moment of valve opening—when the valve starts to open, the gas pressure force and the known spring force and the known magnetic force are in balance, so gas pressure is determined. This pressure information, combined with knowledge of crankshaft angle and therefore of piston position and cylinder volume, indicates the volume and pressure of gases in a cylinder at the moment of valve opening. The system design approach taught here provides a framework for using this kind of information to practical advantage, incorporating it into course corrections that can be computed quickly, on-the-fly. These approaches lead to good convergence for low-impact landings with latching under widely variable operating conditions, even when gas flow conditions were not predicted in advance of an actuation cycle.

We claim:

1. An adaptive system for solenoid control to achieve low impact landing with latching, with variable initial energy, and with variable path drift, comprising:

(a) sense means, for obtaining parameters indicating the state of a controlled solenoid, said state comprising a magnetic state;

(b) path memory means, for retrieval of predetermined information descriptive of possible low-impact landing paths in the state space of said controlled solenoid said information comprising information descriptive of magnetic state;

(c) a variable path number, associated with said information from said path memory means, differentiating said landing paths with respect to initial energy;

(d) a variable path drift parameter, associated with said information from said path memory means, differentiating said landing paths with respect to pattern of drift along among said landing paths;

(e) path number determination means, for comparing said information from said path memory means with said parameters from said sense means, thereby establishing a defined path number associated with said parameters from said sense means;

(f) loss parameter setting means, setting said variable path drift parameter;

(g) magnetic error evaluation means, determining an error between said magnetic state of said controlled solenoid as obtained by said sense means and a magnetic state from said path memory means, corresponding to said defined path and said path drift parameter; and (h) drive control means, responsive to said magnetic error evaluation means and setting an output signal controlling the flow of electrical energy into said controlled solenoid.

2. The system of claim 1, wherein said parameters indicating the state, obtained by said sense means, further comprise a position parameter, a velocity parameter, and a flux linkage parameter.

3. The system of claim 1, wherein said parameters indicating the state, obtained by said sense means, further comprise a position parameter, a velocity parameter, and an electric current parameter.

4. The system of claim 1, wherein the content of said path memory means is predetermined by dynamic simulations.

5. The system of claim 1, wherein said information retrieved by said path memory means is predetermined by instrumented testing of a solenoid.

6. The system of claim 1, wherein said loss parameter setting means uses predetermined information concerning the expected solenoid load, prior to an actuation cycle of said solenoid.

7. The system of claim 1, wherein said loss parameter setting means uses a path number drift parameter from a previous actuation cycle of said solenoid.

8. The system of claim 1, wherein said loss parameter setting means uses a path number drift parameter from a current, ongoing actuation cycle of said solenoid.

9. A system for control of nonlinear dynamic systems of at least third order, for reaching a target destination in a state space from any among multiple entry points, comprising:

(a) sense means, for obtaining parameters indicating the state of a controlled system;

(b) path memory means, for retrieval of information descriptive of possible paths reaching a target destination in said state space of said controlled system;

(c) a variable path number, associated with said information from said path memory means, differentiating said paths with respect to a measure of distance in said state space from said target destination;

(d) a variable path perturbation parameter, selecting from an array of path perturbations associated with said path memory means;

(e) path number identification means, for comparing said information from said path memory means with said parameters from said sense means, thereby defining a nearest path number associated with said parameters from said sense means and further associated with a selected value of said path perturbation parameter;

(f) error evaluation means, defining a scalar error based on said nearest path number and on said state indicated by said parameters obtained by said sense means;

(g) drive control means, responsive to said scalar error by controlling a variable drive input to said controlled system, thereby reducing said scalar error;

(h) path drift evaluation means, quantifying a systematic drift from said nearest path number; and, (i) drift reduction means, responsive to said quantifying by said path drift evaluation means by setting said path perturbation parameter to a value that reduces said systematic drift.

10. The system of claim 9, wherein said measure of distance is a measure of energy change required to reach said target destination from an entry point associated with a specified value of said variable path number.

11. A system for control of a solenoid actuator to achieve low impact landing with latching under varying conditions, said system comprising:

(a) memory means for storing and retrieving predetermined trajectory information describing a multiplicity of trajectories within a state space that lead to low impact landing with latching, each of said multiplicity of trajectories corresponding to each of a multiplicity of operating conditions;

(b) means for determining the present state of said solenoid actuator within said state space;

(c) means for comparing said present state with said predetermined trajectory information, thereby defining a distance between said present state and a state along said multiplicity of trajectories; and (d) drive control means for setting an output signal in accordance with said distance; whereby the dynamically changing state of said solenoid actuator is caused to approach a trajectory among said multiplicity of trajectories.

12. The system of claim 11, wherein a first dimension of said state space is a measure of position, said measure of position being selected from the group consisting of physical position, displacement and potential energy of said solenoid actuator.

13. The system of claim 11, wherein a second dimension of said state space is a measure of velocity, said measure of velocity being selected from the group consisting of physical velocity, momentum and kinetic energy of said solenoid actuator.

14. The system of claim 13, wherein said measure of velocity is determined by the difference between two separate measures of position taken at two corresponding known times.

15. The system of claim 11, wherein a third dimension of said state space is a measure of the magnetic influence acting upon said solenoid actuator, said measure of magnetic influence being selected from the group consisting of flux linkage and electrical current.

16. The system of claim 11, wherein said output signal is a voltage.

17. The system of claim 11, wherein said means for determining the present state of said solenoid comprise a measured current, an applied voltage, and a flux linkage, said flux linkage inferred from time integration of an inductive voltage, said inductive voltage being determined from said measured current and said applied voltage.

18. The system of claim 17, wherein said applied voltage is established by said setting of said output signal.

19. The system of claim 17, wherein said applied voltage is determined by a known supply voltage and a pulse width modulation duty cycle.

20. The system of claim 17, wherein said measured current and said flux linkage together establish a measure of the position of said solenoid actuator.

21. The system of claim 20, wherein differences in said measure of position measured at different times constitute a measure of velocity, whereby the state of said solenoid is defined by said measure of position, said measure of velocity, and said flux linkage.

22. The system of claim 11, wherein a multiplicity of numbered trajectories leading to low impact landing with latching form in said state space a two-dimensional ribbon of sequentially numbered trajectories, each of said numbered trajectories corresponding to a mechanical energy of said solenoid, and wherein said drive control means causes said dynamically changing state to approach said ribbon, said drive control means further comprising a means to measure systematic drift across said ribbon amongst said numbered trajectories and thereby define a drift error.

23. The system of claim 22, wherein said drift error is used to modify said predetermined trajectory information.

24. The system of claim 22, wherein said drift error is used to select and retrieve a separate multiplicity of numbered trajectories forming a new ribbon which better matches predictive perturbations that are distinct from said operating conditions and are descriptive of present mechanical energy arising from past events.

25. A method for solenoid control to achieve low-impact landing, comprising the steps of:

(a) testing, wherein a test system having response characteristics like those of the solenoid to be controlled is caused to execute test trajectories of differing initial energies that achieve low-impact landings, said low-impact landings including latching and having a speed of impact below a prescribed maximum speed;

(b) path function calibration, wherein parameters of path functions are set such that said path functions describe said test trajectories that achieve said low-impact landing;

(c) calibration programming, wherein a solenoid controller is programmed to recall said path function calibration;

(d) response comparison programming, wherein said solenoid controller is further programmed to make a comparison between a measured solenoid response and at least one of said test trajectories described by said path functions; and (e) drive control programming, responsive to said comparison by controlling an electrical drive signal as part of the actuation of said measured solenoid.

26. The method of claim 25, wherein said test system is a mathematical simulation generating simulated response characteristics analogous to said response characteristics like those of the solenoid to be controlled.

27. The method of claim 25, wherein said test system is an actual solenoid with instrumentation to measure said trajectories.

28. The method of claim 25 wherein said path functions define points in a multi-dimensional space of state space variables.

29. The method of claim 28, wherein the dimensions of said space are transformable into the dimensions of position, velocity, and flux linkage.

30. The method of claim 29, wherein said dimensions are a measured position, a difference between measured positions, and a cumulative total of inductive voltages.

31. The method of claim 30, wherein said inductive voltages are voltages measured from a sense coil;

32. The method of claim 30, wherein said inductive voltages are computed from an applied voltage, an electrical current, and a resistive voltage that is a function of said current.

33. The method of claim 32, wherein said applied voltage is computed from supply voltage information and from the duty cycle of a pulse width modulator.

34. The method of claim 32, wherein said current is measured using a sense resistor.

35. The method of claim 33, wherein said value of resistive voltage is said electrical current multiplied by a resistance.

36. The method of claim 25, wherein said drive control programming comprises determination of a flux linkage projected into the future relative to a measurement time of said measured solenoid response.

37. The method of claim 25, wherein said drive control programming comprises determination of a voltage to be generated in a future period of time relative to a measurement time of said measured solenoid response.

* * * * *